US005788121A

United States Patent [19]

Sasaki et al.

[11] Patent Number: 5,788,121

[45] Date of Patent: Aug. 4, 1998

[54] BAG FOR BAG-IN-BOX AND BAG-IN-BOX

[75] Inventors: Hitoshi Sasaki; Mitsuru Ohba, both of Kawasaki; Raizo Kuge; Susumu Niwa, both of Tokyo-to, all of Japan

[73] Assignee: Kabushiki Kaisha Hosokawa Yoko, Tokyo-to, Japan

[21] Appl. No.: 559,038

[22] Filed: Nov. 15, 1995

[30] Foreign Application Priority Data

Nov. 18, 1994 [JP] Japan ..... 6-284882

[51] Int. Cl.[6] ..... B65D 35/56

[52] U.S. Cl. ..... 222/105; 222/183; 220/403; 220/410; 383/120; 383/906

[58] Field of Search ..... 222/105, 183, 222/541.6; 220/403, 410; 383/104, 120, 906

[56] References Cited

U.S. PATENT DOCUMENTS

| | | | |
|---|---|---|---|
| 3,087,655 | 4/1963 | Scholle | 222/105 X |
| 3,100,587 | 8/1963 | Cox, Jr. | 222/105 |
| 3,108,732 | 10/1963 | Curie et al. | 222/105 X |
| 3,743,172 | 7/1973 | Ackley et al. | 383/104 |
| 4,660,737 | 4/1987 | Green et al. | 222/105 X |
| 4,815,631 | 3/1989 | Eeg et al. | 220/403 |
| 5,195,829 | 3/1993 | Watkins et al. | 383/120 X |
| 5,547,284 | 8/1996 | Imer | 383/120 X |

*Primary Examiner*—Joseph Kaufman

*Attorney, Agent, or Firm*—Kane, Dalsimer, Sullivan, Kurucz, Levy, Eisele and Richard, LLP

[57] ABSTRACT

The bag for bag-in-box of this invention comprises: a bag body composed of flat portions and side portions each having a folding line along which the side portion is folded inward; oblique seal portions provided at respective corner portions of the bag body, the oblique seal portion being formed by obliquely cutting-off the respective corner portions; and a triangular fin portion integrally formed with the oblique seal portion; wherein the flat portion and the side portion are composed of several sheets of synthetic resin films that are superposed to each other. The dimensions of the bag shall be set within a predetermined range so as to meet the International Standard of a pallet. The opening portion to be formed on the outer box of the bag-in-box has a size enabling to sufficiently draw out a spout and the bag body portion around the spout to form a funnel-shape. According to the present invention, there can be provided an inner bag for a bag-in-box excellent in shock resistance, content discharging property and self-supporting property at a time when the inner bag is filled with the content.

10 Claims, 12 Drawing Sheets

BAG FOR BAG-IN-BOX AND BAG-IN-BOX

BACKGROUND OF THE INVENTION

The present invention relates to a bag for a bag-in-box and a bag-in-box that are used for storing or transporting various liquid products such as beverage, motor oil, detergent, or liquid product containing solid component, or fluid such as powdery material produced in the food industry, automobile industry or toiletry industry.

In particular, the present invention relates to an inner bag which is used in a bag-in-box, and is excellent in shock resistance, content discharging and self-supporting when the inner bag is filled with the content or when the bag is taken out from the outer box of the bag-in-box. The present invention also relates to an inner bag to be used in a bag-in-box which can be lined up or arranged on a pallet without causing a dead space or waste space on the pallet prepared in accordance with the International Standard, and has a sufficient stability and strength even when the bag-in-boxes are piled-up in several steps, and has a compact shape, and is easy to handle.

In addition, the present invention relates to a bag-in-box with an improved handling property and content discharging property when the content is taken out from the bag-in-box.

DESCRIPTION OF THE RELATED ART

In recent years, a bag-in-box, which is a non-returnable container, or a so-called "one-way container", is widely used for transporting or storing various liquids products such as beverages including mineral water and industrial chemicals.

The bag-in-box comprises a foldable plastic bag or container as an inner package and an outer box as an outer package.

The inner package is, for example, composed of a flat bag prepared by seal working plastic films, or an integrated molding manufactured by blow-molding fused plastic into an integrated mold, and so on. The water resistance, chemical resistance and gas-barrier property against the liquid content are allotted to the inner package such as the plastic bag or the container.

On the other hand, the outer package is, for example, composed of corrugated fiberboard or the like, enclosing the inner package. The rigidity required for transporting and storing the box is allotted to the outer box.

Since thus constructed bag-in-box is not necessary to be returned or recovered unlike the conventional glass bottles or tin cans, it has advantages in labor-saving and lower cost. Further, since the bag-in-box is foldable, it is easy to transport or store the bag-in-box in its empty state, thus reducing distribution cost or circulation cost of the containers.

The inner bag for the bag-in-box, as shown in FIG. 12, is a plastic flat bag 501 having a spout or an outlet 12 at and upper portion of a bag body 1. As shown in FIG. 13, the flat bag 501 is filled with liquid as content, and is accommodated within the outer box 41 and then sealed.

However, the inner bag of this flat type is inferior at conforming to an interior shape of the outer box. Therefore, when the inner bag is accommodated within the outer box, waste space or dead space 42 is liable to occur between the outer box and the inner bag. At the same time, a corner portion 4 of the inner bag is crumpled or bent so as to follow up to the interior shape of the outer box. Such folds and crimps are also liable to occur at portions other than the corner portions.

When the dead space 42 is formed between the outer box and the inner bag, the inner bag becomes easy to move within the outer box. Therefore, when a large shock or impact is applied to the bag-in-box at the time of its dropping or falling, the inner bag is liable to be easily broken. Even when a relatively small impact such as vibrations is applied to the bag-in-box, the inner bag is also liable to be broken because it is worn out by rubbing.

Further, when a part of the inner bag, especially the corner portion 4, is crumpled or bent, residual liquid content will remain in the crumpled or bent portion forming, so-called, "perched water", so that it is difficult to completely discharge the content from the inner bag. In particular, the bag-in-box has a relatively large capacity, so that an amount of the residual liquid content remaining at the crumpled or bent portion is also large. Therefore, it becomes an important problem to improve the discharging property of the residual fluid content.

Furthermore, the flat bag type inner bag inherently is not self-supporting, so that it is inconvenient or troublesome to handle the inner bag at the time when the liquid product is filled into the inner bag. Subsequently the inner bag is accommodated within the outer box in the manufacturing process of the bag-in-box.

There is a case where only the inner bag is used or operated with the outer box being removed in accordance with environmental conditions. For example,there may be a case where the bag-in-box is used and handled at a wet place having a high moisture. In this case, the outer box composed of corrugated fiberboard is removed from the bag-in-box, and only the inner bag is used in a naked state. In such a case, when the inner bag has no self-supporting property, it is also inconvenient to handle the naked inner bag.

On the other hand, for obtaining an easy handling and operation of the bag-in-box, and for compactly piling or stacking the bag-in-box during storing or transportation, a cubic shape is preferably selected as a shape of the bag-in-box. From this viewpoint, a bag-in-box having capacity of 20 liters or so, which is popularly in demand, is formed to be a cube having a side length of about 300 mm.

In recent years, however, the size of a pallet onto which various articles are loaded or piled was standardized to 1100 mm–1100 mm in accordance with the International Standard. Therefore, this internationally standardized pallet has spread to all over the world, and all facilities of a distribution center dealing with the pallet seem to adapt the standards or specifications to meet the internationally standardized pallet.

However, when the bag-in-boxes each having a cubic shape of which the side length is about 300 mm are lined-up or arranged on the internationally standardized pallet, only a total of nine boxes arranged in three rows by three rows can be loaded per level on the pallet. Thus, there is a problem of a lot of waste space or unused space (dead space) on the pallet. In addition, in case of the cubic bag-in-boxes, since they are piled up on the pallet in a rod-shaped configuration, the piled boxes lack stability during loading or transporting thereof.

The specification of the outer box for the bag-in-box has a great influence onto the discharging property and handling property of the bag-in-box, and this influence may not be negligible. In the case of taking the liquid content out of the bag-in-box, for example, the following operation is performed. Namely, the user or operator holds the outer box with both hands while a bottom edge of the outer box is supported by a holder. Then, the content flowing out from a pouring opening (spout) protruding from the outer box is received into another appropriate container.

In a case where the inner bag of the bag-in-box is a flat bag, the pouring opening (spout) is usually fixed to an opening portion of the outer box, so that many folded portions and corrugations are disadvantageously formed in a bag body around the pouring opening to be superposed to each other. The folded portions and corrugations formed at and around the pouring opening cause not only a difficulty in discharging the content but also a pulsation in the discharging the content, thus resulting in dripping-out or spilling-out of the content. In addition, the pouring opening is fixed to the outer box and is not formed in a long hose-shape but formed shortly, so that it is impossible to control a pouring direction of the discharging content by taking hold of the pouring opening with a hand. This also results in dripping-out or spilling-out of the content whereby the working site is polluted by the dripped-out content.

On the other hand, in a case where the inner bag for the bag-in-box is an integrated molding prepared by a blow-molding method or the like, the inner bag is formed so as to have a shape close to the interior shape of the outer box, and the pouring opening provided on the inner bag is not fixed to the outer box. The bag body around the pouring opening is formed so as to have a funnel-shape, so that it is easy to collect the residual content together into the pouring opening portion at the time of completely discharging the residual content.

Further, since the pouring opening is not fixed to the outer box, the pouring opening has a freedom of a certain degree, and it is slightly possible to control the discharging direction of the content to some extent. However, the integrated molding type inner bag is formed thick and has an inferior transparency, so that it is difficult to visually confirm a residual amount of the content at the time of finally using-up the content. Further, the pouring opening is formed thick and rigid, and a length of the pouring opening is short. Though the pouring opening is a slightly movable to a certain extent, the same as the case of flat bag, it is difficult to control the discharging direction of the content by grasping the pouring opening with a hand.

SUMMARY OF THE INVENTION

Accordingly, the present invention has been accomplished in consideration of afore-mentioned circumstances, and it is a first object of this invention to provide an inner bag which is used in a bag-in-box, and is excellent in shock resistance, content discharging and self-supporting at a time when the liquid content is supplied into the inner bag or when the bag is taken out from the outer box of the bag-in-box.

A second object of the present invention is to provide an inner bag to be used in a bag-in-box which can be lined-up or arranged on an internationally standardized pallet without causing a dead space, and has a sufficient stability and strength even when the bag-in-boxes are piled-up in several steps, and has a compact shape, and is easy to handle or transport in comparison with a conventional cubic bag-in-box.

A third object of this invention is to provide a bag-in-box to easily control the pouring or discharging direction of the content, and capable of visually confirming an amount of the residual content, and to reduce the residual amount of the content remaining in the bag-in-box.

To achieve the foregoing objects and in accordance with the purpose of this invention, a bag for a bag-in-box of this invention comprises:

a four-side-seal type bag body composed of a pair of opposing flat portions constituting front and back side portions of the bag body and two side portions connecting front and back side portions at both side ends thereof and respectively having folding lines along which the side portions are folded inward;

oblique seal portions provided at respective corner portions of the bag body; and triangular fin portions formed at respective corner portions of the bag body, wherein the flat portions and the side portions constituting the bag body are composed of at least two sheets of synthetic resin films that are superposed to each other in non-bonded state, wherein the oblique seal portion is formed such that the bag body is folded so as to provide two side portions each having the folding line, between the superposed pair of flat portions, then opposing inner surfaces of the bag body are bonded to each other in a range from an arbitrary point on top seal portion or bottom seal portion to another arbitrary point on side seal portion so as to obliquely connect the top or bottom seal portion and the side seal portion, thereby to form the oblique seal portion having a straight band-shape, and wherein the triangular fin portion is formed by being enclosed with the side seal portion, the oblique seal portion and one of the top seal portion and bottom seal portion on three sides.

The present invention can be adapted for some preferable embodiments. In one aspect of this invention, a bag for bag-in-box can be constructed so that each of the flat portions and the side portions have a shape of square or rectangle, and the bag takes a shape of cube or rectangular parallelepiped after the bag is filled up with content.

In another aspect of this invention, a bag for bag-in-box can be constructed so that the arbitrary point to be set on the top seal portion or the bottom seal portion is set within a range from a crossing point of the folding line of the side portion and the top seal portion or the bottom seal portion to a point, on the top seal portion or the bottom seal portion, apart from the crossing point to a length of 1 cm.

In further aspect of this invention, a bag for bag-in-box can be constructed so that opposing top portions of the corner portions formed at front and back sides of the bag body are bonded to each other.

In still further aspect of this invention, a bag for bag-in-box can be constructed so that at least one band-shaped film segment or gas-filled layer extending toward the vertical direction of the bag body is attached or provided on each of a pair of flat portions and two side portions, respectively.

In still further aspect of this invention, a bag for bag-in-box can be constructed so that a bilateral pair of hanger portions are formed on at least one of the top and bottom sides of the bag body, the hanger portion is formed by bonding the opposing triangular fin portions of both front side and back side to each other at the top portions of the corner portions, and by further bonding the opposing triangular fin portions at a portion including at least one portion on the top seal portion or the bottom seal portion.

In a still further aspect of this invention, a bag for bag-in-box can be constructed so that a punched hole is formed on at least one of the triangular fin portions.

In a still further aspect of this invention, a bag for bag-in-box can be constructed so that the synthetic resin film contains at least one metal foil layer.

In a still further aspect of this invention, a bag for bag-in-box can be constructed so that an angle lying between the top seal portion and the oblique seal portion is 45–55 degrees, and an angle lying between the bottom seal portion and the oblique seal portion is 40–50 degrees.

In a still further aspect of this invention, a bag for bag-in-box can be constructed so that a horizontal dimension of the flat portion is 260–340 mm, a horizontal dimension of the side portion is 180–260 mm, a vertical dimension of each of the flat and side portions is 490–660 mm, each of the dimensions being expressed as a substantial dimension which is defined by subtracting the width of the seal portion from each actual dimension of respective portions, and a shape of the bag after filling up content therein is a rectangular parallelepiped.

In a still further aspect of this invention, a bag for bag-in-box can be constructed so that a horizontal dimension of the flat portion is 190–270 mm, a horizontal dimension of the side portion is 140–220 mm, a vertical dimension of each of the flat and side portions is 330–600 mm, each of said dimensions being expressed as a substantial dimension which is defined by subtracting the width of the seal portion from each actual dimension of respective portions, and a shape of the bag after filling up content therein is a rectangular parallelepiped.

Further, a bag-in-box according to the present invention comprises:

an outer box;

a bag according to any one of aforementioned various bags or a four-side-seal type bag e.g., a flat bag composed of synthetic resin films, which is accommodated within the outer box, and is used as an inner bag for storing liquid or fluid content therein;

a spout provided on the bag, for pouring out the liquid content stored in the bag; and an unsealing assisting member provided on one surface portion of the outer box, for forming an opening portion having a sufficient size or diameter enabling to draw out the spout together with a bag body portion around the spout to a length of 50 mm or more when the spout provided on the inner bag is protruded from the outer box through the opening portion.

In another aspect of this invention, the bag-in-box can be constructed so that the unsealing assisting member provided on one surface portion of the outer bag, for forming an opening portion has a sufficient size enabling to draw out the spout together with a bag body portion around the spout in a length of 50–150 mm when the spout provided on the inner bag is protruded from the outer box through the opening portion.

Preferably, the unsealing assisting member can be constructed so that, at the time of unsealing, one surface portion of the outer box can be radially torn from a center point of the opening portion, and after the unsealing, fan-shaped pieces remain surrounding the opening portion.

Preferably, the inner bag can be constructed so as to have a capacity of 5–25 liters, and the outer box may also preferably have a shape of a cube or a rectangular parallelepiped.

The bag for a bag-in-box according to the present invention performs the following functions:

First, the bag for a bag-in-box of this invention has a columnar structure which is enclosed by front and back flat portions and side portions each having a gusset, wherein side edge potions of flat portions and side portions are sealed to each other, and each of the corner portions of both top and bottom side portions is provided with a straight band-shaped oblique seal portion just like the corner portion is obliquely cut-off, so that the bag shall take a shape close to a cube or a rectangular parallelepiped. Therefore, the bag for bag-in-box according to this invention is excellent in conforming to an interior shape of the outer box having a shape of a cube or a rectangular parallelepiped, and can be tightly accommodated within the outer box. In addition, the dead space formed between the outer box and the inner bag is very small, so that the inner bag hardly moves within the outer box, and also a bursting due to the impact or breakage due to the rubbing of the inner bag hardly occurs.

Secondly, each of the corner portions of the bag for the bag-in-box of this invention is provided with a triangular fin portion into which the liquid content cannot enter because the fin portion is completely closed or isolated from an inner space of the bag body. Therefore, there is no case of the residual content remaining in the corner portion, so that the discharging property of the liquid content residual can be improved. Further, the above-described oblique seal portion integrally formed with the triangular fin portion has a stress-dispersing effect with respect to the impact applied to the bag, so that the impact resistance of the bag body can also be improved.

Thirdly, the bag for the bag-in-box of this invention takes a shape close to a cube or a rectangular parallelepiped when the bag is filled with content, so that the bag is excellent in self-supporting. Therefore, it is easy to handle the inner bag at the time when the liquid product is filled into the inner bag, and the inner bag is subsequently accommodated within the outer box in the manufacturing process of the bag-in-box, or when the outer box is removed from the bag-in-box to use only the inner bag in a naked state.

Fourthly, the flat portions and the side portions of the bag for the bag-in-box of this invention are composed of at least two sheets of synthetic resin films that are superposed to each other in a non-bonded state, so that only an outside synthetic resin film shall rub against the outer box, resulting in wearing out. On the other hand, an inside synthetic resin film slidably contacts the outside synthetic resin film, so that the inside synthetic film hardly wears out. Accordingly, the flat portion and the side portion composed of at least two sheets of synthetic resin films are hard to break in comparison with those composed of a single sheet of synthetic resin film having the same thickness. Further, in a case where the flat portion and the side portion are composed of the several sheets of synthetic resin films superposed to each other, thus formed flat and side portions are more flexible in comparison with those composed of a single sheet of synthetic resin film having the same thickness, so that it is easy to handle the inner bag at the time of the inner bag being accommodated within the outer box.

In one aspect of a preferred embodiment of this invention, when the bag for the bag-in-box is constructed so that each of the flat portions and the side portions has a shape of square or rectangle, the bag takes a shape of a cube or a rectangular parallelepiped after the bag is filled up with content. Accordingly, there can be provided a bag-in-box which can be tightly and closely loaded or piled on the internationally standardized pallet, and has a compact shape, high strength and an excellent stability. In addition, even in a case where a lot of the bag-in-boxes are piled on the pallet in a heap form, the entire piled-up heap can also be sufficiently secure and high strength.

In another aspect of a preferred embodiment of this invention, when the bag for the bag-in-box is constructed so that the arbitrary point to be set on the top seal portion or the bottom seal portion and to be a starting point of the oblique seal portion is set within a range from a crossing point of the folding line of the side portion and the top seal portion or the bottom seal portion to a point, on the top seal portion or the bottom seal portion, apart from the crossing point in a length of 1 cm, so that the bag 101 shall have a shape close to cube or rectangular parallelepiped after the content is filled up in the bag.

In a further aspect of a preferred embodiment of this invention, when opposing top points of the corner portions formed at front and back sides of the bag body are bonded to each other, the triangular fin portion would not crumple or bend to unspecified direction, so that the triangular fin portion would not obstruct the operations to be performed at the time when the liquid or fluid product is filled into the inner bag. Subsequently, the inner bag is accommodated within the outer box in the manufacturing process of the bag-in-box, or when the outer box is removed from the bag-in-box, and only the inner bag is used in a naked state.

In addition, due to the existence of the triangular fin portion, a bag wall of a portion into which content is filled would not directly contact the upper or lower wall of the outer box, rubbing, tearing, or pin-holing is caused on the bag by vibrations or the like can be effectively prevented.

In another aspect of the preferred embodiment of this invention, when at least one of a band-shaped film segment or a gas-filled layer is attached or provided on respective flat portions and two side portions so as to extend toward the vertical direction of the bag body, the self-supporting property of the inner bag can be further improved. As described above, the bag for bag-in-box of this invention is self-supporting. However, when the capacity of the bag is relatively large, there may be a case where a shell portion of the bag body is liable to sag or became loose at the time before and after the liquid content is filled into the bag body, and the self-supporting property of the bag body becomes insufficient. When the band-shaped film segment or gas-filled layer is attached or provided on the respective flat portions and two side portions, stiffness and flexural rigidity of the shell portion of the bag body is increased, so that the sag of the shell portion is reduced and the self-supporting property of the inner bag can be further improved.

In a further aspect of the preferred embodiment of this invention, when the opposing triangular fin portions of both front and back sides are bonded to each other at the top portions of the corner portions, and further the opposing triangular fin portions are bonded at a portion including at least one portion on the top seal portion and/or the bottom seal portion, a bilateral pair of hanger portions are formed on at least one of the top and bottom sides of the bag body, so that it becomes possible to hang the bag body by inserting a hand of a user or a machine hand into a space formed between the fin portion and the shell portion of the bag.

In a still further aspect of the preferred embodiment of this invention, when a punched hole is formed on at least one of the triangular fin portions provided at respective corner portions of the bag body, a hook or the like can be engaged to the punched hole, thus making it possible to assist the self-supporting property of the bag body and to suspend or hang the bag. Therefore, it is easy to handle the bag during the manufacturing process of the bag-in-box and in a case where only the bag is used in a naked state.

In a still further aspect of the preferred embodiment of this invention, when at least one layer constituting the synthetic resin film is formed into a metal foil layer, the light shielding property of the bag becomes extremely high, and self-supporting property of the bag can also be improved due to shape- retention effect of the metal foil layer.

In a still further aspect of the preferred embodiment of this invention, when an angle lying between the top seal portion and the oblique seal portion is set at 45–55 degrees, and an angle lying between the bottom seal portion and the oblique seal portion is set at 40–50 degrees, there can be obtained an excellent conforming property of the inner bag with respect to the interior shape of the outer box and an especially excellent effect of decreasing the amount of the residual content.

That is, by setting the angle lying between the bottom seal portion and the closed seal portion at 40–50 degrees, there can be formed a bag whose bottom has a shape extremely close to that of a cube or a rectangular parallelepiped when the bag is filled-up with the content. Further, the oblique seal portion can be provided along the exact portion at which the corner portion is crumpled or bent, so that the residual fluid content can be effectively prevented from remaining in the corner portion while securing a maximum filling capacity. In such a range of the angle, there can be obtained a maximum stress dispersing effect.

On the other hand, the top portion of the bag body is drawn downward by the weight of the content. In addition, the top portion is often provided with a spout for pouring out the content. Further, at the top portion of the bag body, there is a little void space for preventing the content from overflowing or spilling out from the bag body at the time of unsealing the bag. In view of this, the top portion of the bag body is not as flat as bottom portion, and takes a slightly sharpened shape in its upper direction, so that the corner portion of top side is liable to crumple or bend at a deeper position than that of the bottom side corner portion. Accordingly, the position of the oblique seal portion of the top side is set at slightly deep level by setting the angle lying between the top seal portion and the oblique seal portion at 45–55 degrees, and the oblique seal portion on the top side is also provided along a position at which the corner portion is crumpled or bent. As a result, the residual fluid content of the top side can be effectively prevented from remaining in the corner portion while securing a maximum filling capacity.

In a still further aspect of the preferred embodiment of this invention, when a horizontal dimension of the flat portion is set at 260–340 mm, a horizontal dimension of the side portion is set at 180–260 mm, a vertical dimension of each of the flat and side portions is 490–660 mm, each of said dimensions being expressed as a substantial dimension which is defined by subtracting the width of the seal portion from each actual dimension of respective portions, and a shape of the bag after filling liquid content therein is set to a rectangular parallelepiped, there can be provided a bag-in-box having a capacity of 20 liters or so, which is well suited to the internationally standardized pallet.

Namely, when the bag having an afore-mentioned dimension is filled with the content, the bag takes a shape of an almost rectangular parallelepiped whose horizontal dimension of the flat portion is 260–340 mm, horizontal dimension of the side portion is 180–260 mm, and height is 230–480 mm, and has a capacity of 20 liters or so. Accordingly, when this bag is used as an inner bag, there can be provided a bag-in-box having a shape of a rectangular parallelepiped, a capacity of 20 liters or so, and substantially the same dimensions as those of the bag. In this regard, the height of the bag after being filled with content is shorter than a vertical dimension of flat and side portions before being filled. The difference is equivalent to the horizontal dimension of the side portion. This is because the upper and lower edges of the flat portion and the side portion enter or shift to an upper surface side and lower surface side of the bag thereby forming an upper surface and bottom surface at the time of the bag being filled with content.

Thus, the bag-in-box having a capacity of 20 liters or so and a shape of rectangular parallelepiped can be tightly and closely loaded onto a pallet having dimensions of 1100 mm by 1100 mm in such a manner that total 12 bag-in-boxes are arranged in a form of 4 rows by 3 rows per every level on the pallet. In addition, as far as the dimensions of the bag-in-box are set within the above described ranges, the shape of the bag-in-box will not become too thin or too slender, so that it is easy for a user to grasp or handle the bag-in-box, and the box has a sufficient stability and high strength.

Further, in case of the bag-in-box having a shape of a rectangular parallelepiped, the bag-in-box can be multi-stepwisely piled-up in a well-crib form by changing the arranging direction for the box per every level, so that an entire piled-up heap can also have a sufficient stability and high strength.

In the preferred eighth embodiment, when a horizontal dimension of the flat portion is set at 190–270 mm, a horizontal dimension of the side portion is set at 140–220 mm, a vertical dimension of each of the flat and side portions is set at 330–600 mm, each of the dimensions being expressed as a substantial dimension which is defined by subtracting the width of the seal portion from each actual dimension of respective portions, and a shape of the bag after being filled with the content is a rectangular parallelepiped, there can be provided a bag-in-box having a capacity of 10 liters or so, and is well suited to the internationally standardized pallet.

Namely, the bag having afore-mentioned dimensions has a capacity of 10 liters or so. When the bag is filled with the content, the bag takes a shape of an almost rectangular parallelepiped whose horizontal dimension of the flat portion is 190–270 mm, horizontal dimension of the side portion is 140–220 mm, and height is 110–460 mm. Accordingly, when this bag is used as an inner bag, there can be provided a bag-in-box having a shape of a rectangular parallelepiped, a capacity of 10 liters or so, and substantially the same dimensions as those of the bag.

Thus, the bag-in-box having a capacity of 10 liters or so and a shape of rectangular parallelepiped can be tightly and closely loaded onto a pallet having dimensions of 1100 mm by 1100 mm in such a manner that total 20 bag-in-boxes are arranged in a form of 5 rows by 4 rows per every level on the pallet. In addition, as is the same as the former embodiment, as far as the dimensions of the bag-in-box are set within the above described ranges, the shape of the bag-in-box will not become too thin or too slender, so that it is easy for a user to grasp or handle the bag-in-box, and the box has a sufficient stability and high strength. Further, in case of the bag-in-box being a rectangular parallelepiped, the bag-in-box can be stacked in a well-crib form by changing the arranging direction per every level, so that an entire piled-up heap can also have a sufficient stability and high strength.

On the other hand, in the bag-in-box according to the present invention, it is possible to draw out the bag body portion around the spout together with the spout in a length of 50 mm or more from the opening portion which is formed by using the unsealing assisting member and is provided on the outer box, so that a portion around the spout can be formed in a funnel-shape. As the result, the content is easily collected into the spout, and is smoothly discharged. Therefore, the residual of the content hardly remains and pulsation of the content scarcely occurs.

In addition, the spout is sufficiently drawn out and protruded from the outer box, so that the user can easily grasp the spout, and easily control the pouring direction of the content. Furthermore, the inner bag is not an integrated molding but a bag prepared by seal working of the thin synthetic resin film having superior transparency, so that the user can easily and visually confirm the amount of the residual content.

The unsealing assisting member to be provided on the bag-in-box is preferably constructed so that, at the time of unsealing, one surface portion of the outer box can be radially torn from a center point of the opening portion, and after the unsealing, fan-shaped torn pieces remain surrounding of the opening portion.

In this case, the spout and the bag body around the spout drawn out from the opening portion and the bag body around the spout are press-held or supported by the fan-shaped torn pieces remaining at the surrounding of the opening portion, so that a position of the spout can be stabilized.

In particular, when the length of the bag body around the spout to be drawn out from the opening portion is set at 50 mm or more, more preferably 50–150 mm, and when the diameter of the opening portion is set at within a range of 50–150 mm, a proper length of the bag body can be drawn out.

In addition, when the the unsealing assisting member is constructed so that a wall surface of the outer box can be radially torn from a center point of the opening portion, fan-shaped torn pieces remain surrounding the opening portion after the unsealing. In this case, the bag body around the spout drawn out from the opening portion is suppressed or supported by the fan-shaped torn pieces remaining at the surrounding of the opening portion, so that a position of the spout can be advantageously stabilized.

BRIEF DESCRIPTION OF THE DRAWINGS

The accompanying drawings which are incorporated in and constitute a part of this specification, illustrate one embodiment of this invention and, together with the description, serve to explain the principle of this invention.

FIG. 9 is a view explaining one embodiment of the bag-in-box according to the present invention, wherein

FIG. 10 is a view explaining another embodiment of the bag-in-box according to the present invention, wherein

FIG. 11 is a view explaining still another embodiment of the bag-in-box according to the present invention, wherein

DESCRIPTION OF THE PREFERRED EMBODIMENTS

Next, embodiments of the present invention will be explained in more detail with reference to the accompanying drawings.

Reference will now be made in detail to the present preferred embodiment of the present invention, an example of which is illustrated in the accompanying drawings.

Figure 1:
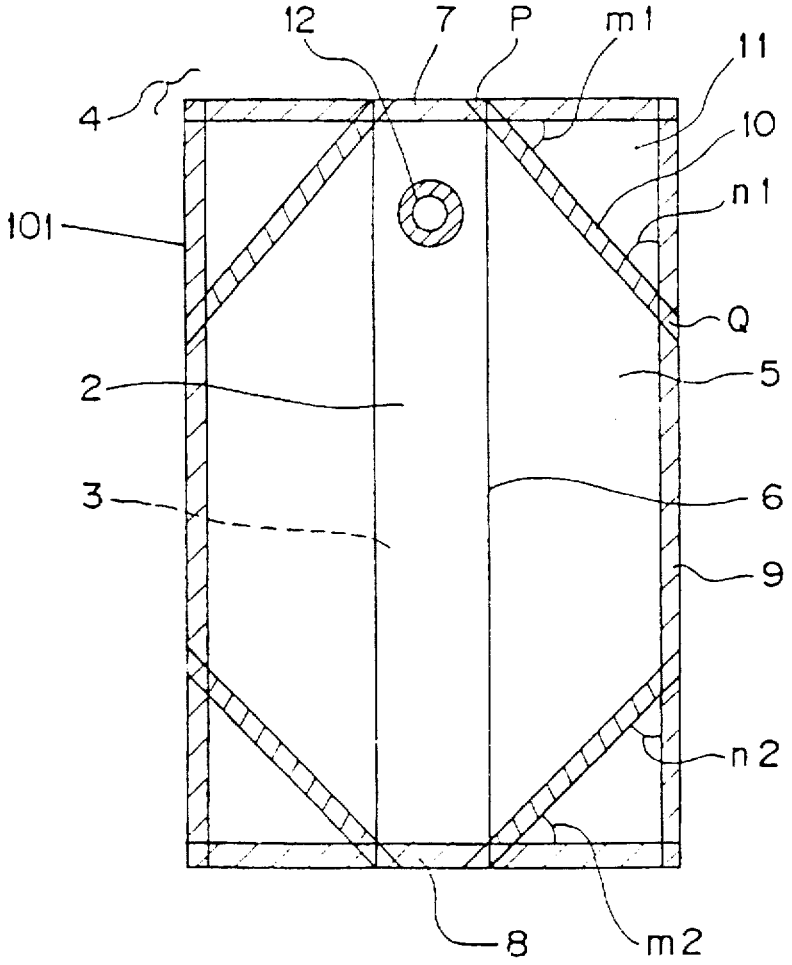
FIG. 1 is a front view showing a state when a bag for a bag-in-box according to one embodiment of the present invention is folded.
Figure 2:
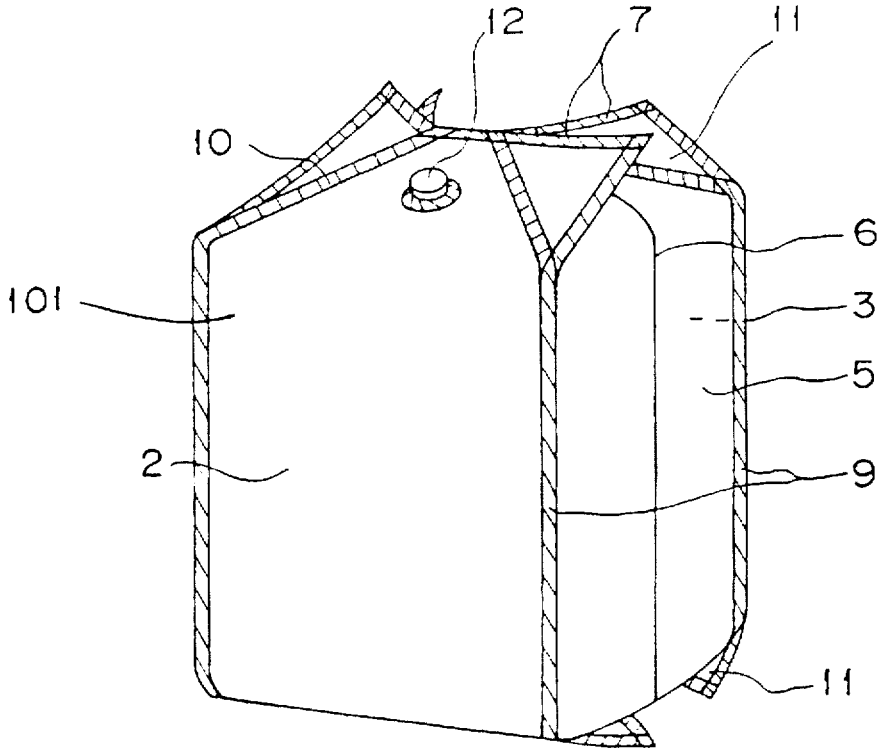
FIG. 2 is a perspective view showing a state when the content is filled into the bag shown in FIG. 1.

FIG. 1 is a front view showing a state when a bag for a bag-in-box according to one embodiment of the present invention is folded, and FIG. 2 is a perspective view showing a state when the content is filled up into the bag shown in FIG. 1.

Referring now to FIGS. 1 and 2, it may be seen that the bag 101 for the bag-in-box of this invention is a bag having a capacity of 20 liters, which is used for transporting or storing water or oil. In this invention, however, the kind of content to be filled into the bag and the capacity of the bag are not particularly restricted or limited. Specific examples of such a content may include: beverages such as potable water, coffee, soup, wine, sake (Japanese liquor), milk, milk beverage, etc.; flavor condiments such as soy sauce, sauce, etc.; and chemical products such as motor oil, detergent, industrial chemicals, etc. The content to be filled in the bag may also be a liquid product containing a solid component or a fluid such as powder material as an example other than liquid product. With respect to the capacity of the bag, it can be optionally selected from a wide capacity ranging from about 5 liters for domestic use to about 20 liters for commercial use.

As shown in FIG. 2, after filling up the content into the bag of this invention, the bag has side gussets and has a shape of almost a cube or a rectangular parallelepiped except the triangular fin portion 11. In case of the bag 101, the shape is almost a rectangular parallelepiped.

The bag 101 comprises: a four-side-seal type bag body composed of a pair of opposing flat portions 2 and 3 constituting front and back side portions of the bag body and two side portions 5 connecting front and back side portions at both side ends thereof and respectively having folding lines 6 along which the side portions 5 are folded inward; top seal portions 7, bottom seal portions 8 and side seal portions 9 respectively provided at the periphery of the bag body; and the oblique seal portions 10 and triangular fin portions 11 are provided at respective corner portion 4 of the bag body.

Each of the flat portions and the side portions has a shape of a square or a rectangle. In case of the bag 101, the flat portions 2, 3 and the side portion 5 have a shape of a rectangle, respectively. A bonding operation for forming the top seal portions 7, bottom seal portions 8 and side seal portions 9 and oblique seal portions 10 is usually performed by using a heat sealing method. In this regard, by bending or folding a film to be used for forming the bag body, a part of the top seal portions 7, bottom seal portions 8 and side seal portions 9 can be omitted. The bag body 101 may properly be provided with an outlet (spout) 12 which is the same as that of the conventional bag for the bag-in-box.

Figure 3:
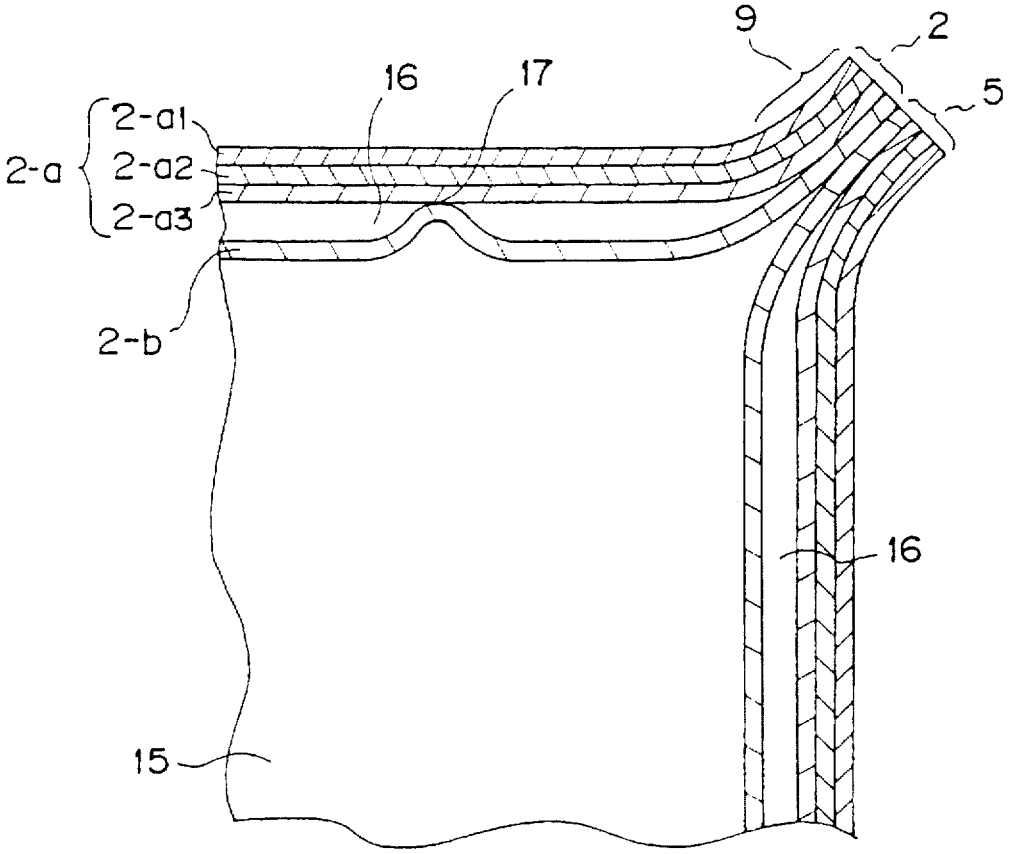
FIG. 3 is a cross-sectional view in a horizontal direction, schematically showing a state when the content is filled up into the bag shown in FIG. 1.

FIG. 3 is a cross-sectional view in a horizontal direction, schematically showing a state when the content is filled into the bag 101. As shown in FIG. 3, the flat portions 2, 3 and the side portions 5 are composed of at least two sheets of synthetic resin films that are superposed to each other in non-bonded state, forming a shock-mitigating structure.

In this regard, the phrase "the portions are composed of at least two sheets of synthetic resin films that are superposed to each other" means that the portion has a laminated structure wherein a plurality of the synthetic resin films are superposed to each other in a separated condition or in a separable condition. A specific example of such construction is shown in FIG. 3 wherein two sheets of the synthetic resin films are superposed to each other in a non-bonded state.

As another example of such a construction, there can be proposed a laminated structure wherein a plurality of the synthetic resin films are pseudo-bonded to each other with a relatively small bonding strength which makes the films easy to separate or peel at a time after the bag is started to be used. Thus pseudo-bonded films are easy in handling and operation in the manufacturing process of the bag.

Referring now to FIG. 3, the flat portion 2 of the front side will be explained. The flat portion 2 comprises an outer film 2-*a* and an inner film 2-*b*, both of the outer and inner films located at respective seal portions such as the side seal portion 9, etc. are bonded to each other. At a non-bonded portion other than the bonded portion, a space 16 is formed between both films. However, both films may also be partially bonded to each other at a portion 17 other than the respective seal portions such as the side seal portion 9, etc. The respective film may be formed of a single layer film just like the film 2-*b* or composite film just like the film 2-*a*.

The specifications such as thickness, kind of material resin to be adapted to the synthetic resin film or respective layers constituting the film are properly determined on the basis of various conditions such as the property of the content, strength, etc., to be required for the bag. In general, the specifications of the outer film 2-*a* or an outside layer 2-*a*1 located outside the outer film are determined in consideration of properties such as strength, wear resistance or the like required in connection with an external environmental condition.

On the other hand, the specifications of the inner film 2-*b* or an inside layer located inside the inner film are determined in consideration of properties such as water resistance, chemical resistance, gas-barrier property or sealing property or the like required in connection with an internal environmental condition. In case of the bag shown in FIG. 3, the aforementioned inside layer does not exist in the inner film 2-*b*.

With regard to a combination of the outer film 2-*a* and the inner film 2-*b* or a combination of the inside layer 2-*a*3 of the outer film and the outside layer of the inner layer, it is preferable to select a combination imparting a good slipping property to both members. In case of the bag shown in FIG. 3, the aforementioned outside layer does not exist in the inner film 2-*b*.

For example, in the flat portions 2, 3 and the side portions 5 of the aforementioned bag 101, the outer film 2-*a* is a composite film whose layer construction has a combination of the outside layer 2-*a*1, an intermediate layer 2-*a*2 and the inside layer 2-*a*3 in this order from outside to inside. Hereinafter, such a combination will be simply expressed as {outside layer 2-*a*1/intermediate layer 2-*a*2/inside layer 2-*a*3}. The outer film 2-*a* has a combination of {15 μm-thick oriented nylon (ON)/20 μm-thick polyethylene(PE)/60 μm-thick linear low density polyethylene (LLDPE)}. On the other hand, the inner film 2-*b* is a single layer film composed of 60 μm-thick LLDPE.

The other specific examples of such a combination may include:

(1) a combination of an outer film composed of {15 μm-thick polyvinylidene chloride coated ON layer (K coated ON)/20 μm-thick PE/60 μm-thick LLDPE} and an inner film composed of {60 μm-thick LLDPE};

(2) a combination of an outer film composed of {12 μm-thick metal vapor deposited polyethylene terephthalate (VMPET)/15 μm-thick ON/20 μm-thick PE/60 μm-thick LLDPE} and an inner film composed of {60 μm-thick LLDPE};

(3) a combination of an outer film composed of {15 μm-thick ON/20 μm-thick PE/60 μm-thick LLDPE•ON•LLDPE co-extrusion film}/and an inner film composed of {60 μm-thick LLDPE•ON•LLDPE co-extrusion film};

(4) a combination of an outer film composed of {15 μm-thick ON/20 μm-thick PE/60 μm-thick LLDPE•ethylene-vinyl alcohol copolymer (EVOH) •LLDPE co-extrusion film}/and an inner film composed of {60 μm-thick LLDPE•EVAL•LLDPE co-extrusion film};

(5) a combination of an outer film composed of {112 μm-thick silica vapor deposited polyethylene terephthalate layer/15 μm-thick ON/20 μm-thick PE/60 μm-thick LLDPE} and an inner film composed of {60 μm-thick LLDPE}; and (6) a combination of an outer film composed of {12 μm-thick alumina vapor deposited polyethylene terephthalate layer/15 μm-thick ON/20 μm-thick PE/60 μm-thick LLDPE} and an inner film composed of {60 μm-thick LLDPE}.

Among the examples of the combination or materials described above, ON is effective to improve the strength of the bag, while K coated ON, VMPET and EVOH are effective to improve the barrier property of the bag. In particular, the combination defined in article (3) is suitable to effectively increase the strength of the bag.

In addition, the synthetic resin film can contain one or more metal foil layers. The metal foil layer can remarkably increase the light shielding property, and enhance the shape-retention effect of the bag, thereby contributing to improve the self-supporting property of the bag. Therefore, the metal foil layer is effective in a case where the outer box has an insufficient light shielding property or in a case where the bag is taken out from the outer box and only the bag is used in a naked state.

In order to form the bag 101 so as to have a shape close to a cube or a rectangular parallelepiped after the content is filled up in the bag, as well as to form the triangular fin portion 11 at the respective corner portion 4, an oblique seal portion 10 is formed at the respective corner portion 4 of the bag body.

This oblique seal portion 10 can be formed in such a manner that the bag body is folded so as to provide two side portions 5 each having the folding line 6, between the superposed pair of flat portions 2 and 3 as shown in FIG. 1. Subsequently, the opposing inner surfaces of the bag body are bonded to each other at a range from an arbitrary point P on top seal portion or bottom seal portion to another arbitrary point Q on a side seal portion so as to obliquely connect the top or bottom seal portion and the side seal portion, thereby forming the oblique seal portion 10 having a straight band-shape.

From a viewpoint that the bag 101 shall have a shape close to a cube or a rectangular parallelepiped after the content is filled up in the bag 101, the arbitrary point P is preferably set as close as possible to a crossing point of the top seal portion 7 or the bottom seal portion 8 and the folding line 6. Therefore, the arbitrary point P is usually set at within a range of ±1 cm from the crossing point. Namely, the point P is set within a range from the crossing point to a point, on the top seal portion or the bottom seal portion, apart from the crossing point in a length of 1 cm. However, the point P is more preferably set at the crossing point.

Further, as is from the same viewpoint as described above, each of the oblique seal portion 10 to be provided at the respective corner portion 4 is preferably formed so that the opposing two oblique seal portions formed at right and left sides, or front and back sides, or top and bottom sides of the bag body are symmetrical to each other.

From a viewpoint that the bag 101 shall have a shape close to a cube or a rectangular parallelepiped at a time after the content is filled up in the bag 101, the oblique seal portion 10 is preferably formed so that the triangular fin portion 11 shall have a shape close to a right-angled isosceles triangle. In order to obtain such a shape, the angle m (m1, m2) lying between either the top seal portion or the bottom seal portion and the oblique seal portion, and the angle n (n1, n2) lying between side seal portion and the oblique seal portion are usually set at a range of 30–60 degrees, preferably at a range of 40–50 degrees, and it is more preferable to set both angles of m and n at 45 degrees. From this point of view, at the bottom side of the bag 101, the both angles of m2 and n2 are equally set at 45 degrees.

However, it is more preferable to set the position of the oblique seal portion of the top side of the bag slightly deeper than that of the oblique seal portion of the bottom side. In other words, a lower limit of the angle m1 lying between the top seal portion and the oblique seal portion shall be set at 45 degrees or more, preferably at 46 degrees or more, more preferably at 48 degrees or more, while an upper limit of the angle m1 shall be set at 55 degrees or less, preferably at 53 degrees or less, more preferably at 52 degrees or less.

The top portion of the bag body is drawn downwardly by the weight of the content. In addition, the top portion is often provided with a spout for pouring out the content. Further, at the top portion of the bag body, there is a little void space for preventing the content from overflowing or spilling out from the bag body. In view of this, an upper surface of the top portion of the bag body is not as flat as that of the bottom portion, and takes a slightly sharpened shape, so that the corner portion of top side is liable to crumple or bend at a deeper position than that of the bottom side corner portion.

Therefore, by adjusting the angle of the top side oblique seal portion at the aforementioned range, or by forming the top side oblique seal portion along a position at which the corner portion is crumpled or bent, the fluid content residual can be effectively prevented remaining in the corner portion while securing a maximum filling capacity of the bag. From this point of view, at the top side of the bag body 101, the angle m1 is set at 50 degrees and the angle n1 is set at 40 degrees, respectively.

At the respective corner portions 4 of the bag body, the triangular fin portion 11 is integrally formed with the oblique seal portion 10 by being enclosed with a side seal portion 9, the oblique seal portion 10 and one of the top seal portion 7 and the bottom seal portion 8 on three sides.

Since an inner space of this triangular fin portion 11 is completely closed from an inner space of the bag body by the oblique seal portion 10, the content cannot enter the triangular fin portion 11. Therefore, even if the respective corner portion 4 at which the triangular fin portion 11 is formed is crumpled or bent at the time of accommodating the bag body 101 into the outer box, there is no case of the residual content remaining in the corner portion 4, so that the residual discharging property of the bag-in-box can be improved. Further, since the above-described oblique seal portion 10 integrally formed with the triangular fin portion 11 has a stress-dispersing effect with respect to an impact applied to the bag, the impact resistance of the bag body can also be improved.

The opposing inner surfaces of the bag body in an area of the triangular fin portion 11 may be formed in a non-bonded state as shown in FIG. 1. However, the opposing inner surfaces may be continuously bonded to each other with the bonded portion of the oblique seal portion 10. In this case, the inner space is not formed in the triangular fin portion 11. Further, the inner surfaces of the triangular fin portion 11 may not be entirely bonded but may be partially or intermittently bonded to each other.

The triangular fin portion 11 is inherently an unnecessary portion for the bag of this invention. When this triangular fin portion 11 is jumped up or crumpled or bent in an unspecified direction, handling of the bag will become complicated or troublesome. For example, when the liquid product is filled into the inner bag, subsequently the inner bag is accommodated within the outer box in the manufacturing process of the bag-in-box, or in a case where the outer box is removed from the bag-in-box, and only the inner bag is used or handled in a naked state, the triangular fin portion 11 would obstruct the operation of the bag.

Figure 4:
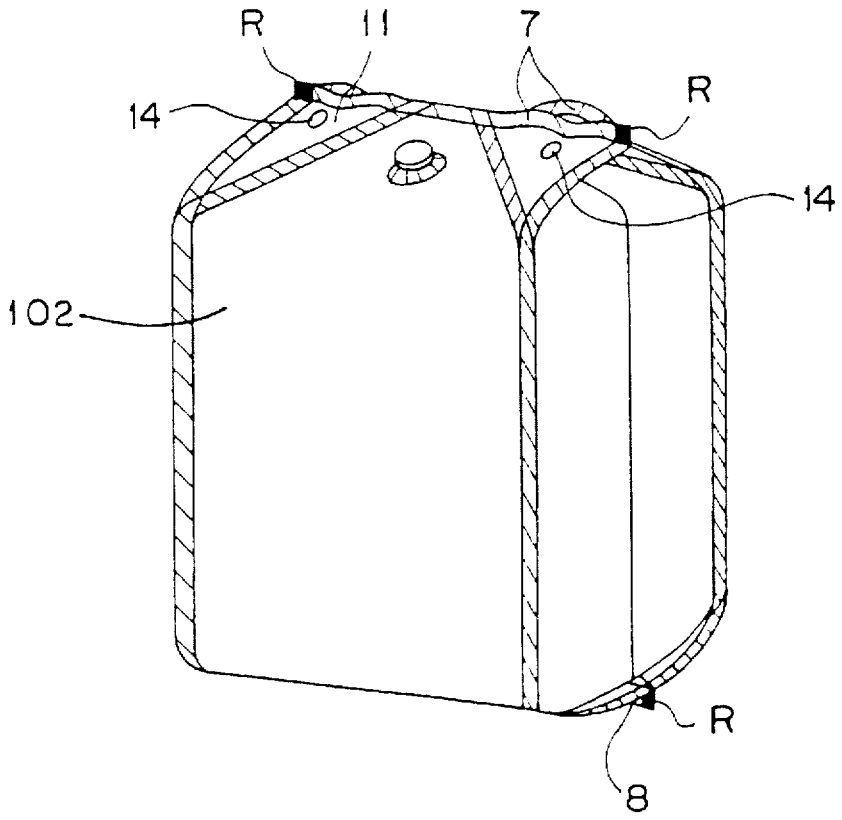
FIG. 4 is a perspective view showing a state when the content is filled into the bag according to another embodiment of this invention.

In order to eliminate such problems, the opposing top points R of the corner portions formed at front and back sides of the bag body are preferably bonded to each other as shown in FIG. 4. As the result, the triangular fin portion 11 would not obstruct the operation of the bag. In addition, due to intervention of the triangular fin portion 11, a bag wall to which content is filled would not directly contact the upper or lower wall of the outer box, so that rubbing, tearing, pin holing caused on the bag by vibrations or the like can be effectively prevented.

When the opposing top portions R are bonded to each other, areas close to the top portions R may also bonded to each other. For example, the opposing top seal portions 7 or bottom seal portions 8 located at the front and back sides of the bag body may be continuously or discontinuously bonded to the bonded portion of the top points R. In case of bonding the opposing top points of the corner portions, a bonding device to be used for forming the respective other seal portions of the bag body can also be used for this bonding purpose.

In addition, by bonding the opposing top seal portions 7 or the bottom seal portions 8 of both front and back sides of the bag body in a continuous or form discontinuous with respect to a bonded portion at the top portion R, a bilateral pair of hanger portions may be formed on at least one of the top and bottom sides of the bag body. In a case where the hanger portions are formed, it becomes possible to hang or suspend the bag body by inserting a hand of a user or a machine hand into a space formed between the fin portion and the shell portion of the bag, thus resulting in a great convenience in transporting the bag or discharging the content stored in the bag. Particularly, in the manufacturing process of the bag body, a heavy bag filled with the content therein can be lifted and easily accommodated into the outer box by utilizing the machine hand, so that it becomes possible to realize labor-saving by manpower reduction, and to introduce an aseptic filling system thereby advantageously improving environmental sanitation.

The bonded portion which forms the aforementioned hanger portion continuously or discontinuously with respect to the bonded portion located at the top portion R, may be either a band-shaped seal portion or a point seal portion (spot seal portion) having a circular, ellipsoidal, quadrangle shape and so forth.

As shown in FIG. 4, a punched hole 14 may be formed on at least one of the triangular fin portions 11. By engaging a hook to the punched hole 14, it becomes possible to assist the self-supporting property of the bag body and to suspend or hang the bag. Therefore, it is easy and convenient to handle the bag at the time of filling the content into the bag or accommodating the bag into the outer box in the manufacturing process of the bag-in-box and in a case where the inner bag is taken out form the outer box and only the bag is used in a naked state. In general, as shown in FIG. 4, a pair of punched holes 14 are formed at right and left sides of the top potion of the bag so as to pass through the two sheets of triangular fin portions 11 of both front and back sides. In this regard, the number and location of the punched hole 14 are not particularly restricted, and for example, a pair of punched holes 14 may also be formed at both right and left sides of the bottom portion of the bag.

Figure 5:
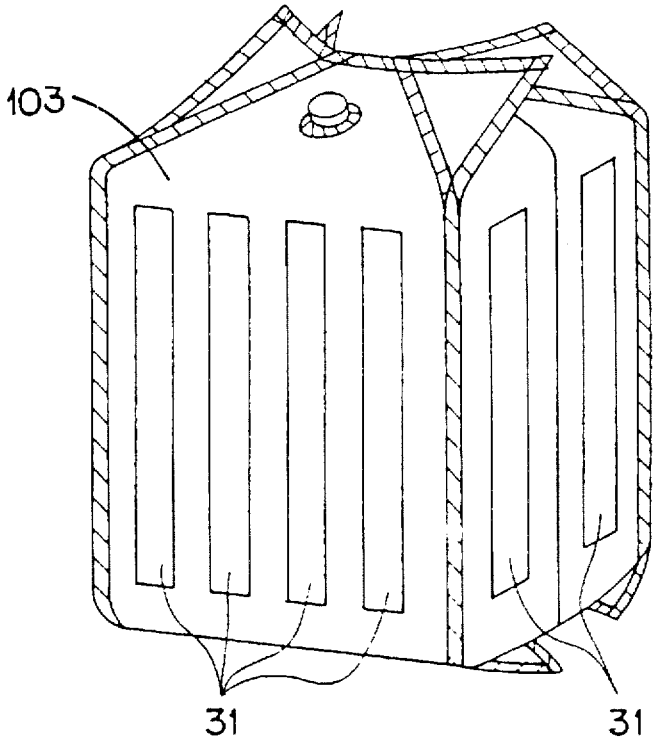
FIG. 5 is a perspective view showing a state when the content is filled into the bag according to still another embodiment of this invention.
Figure 6:
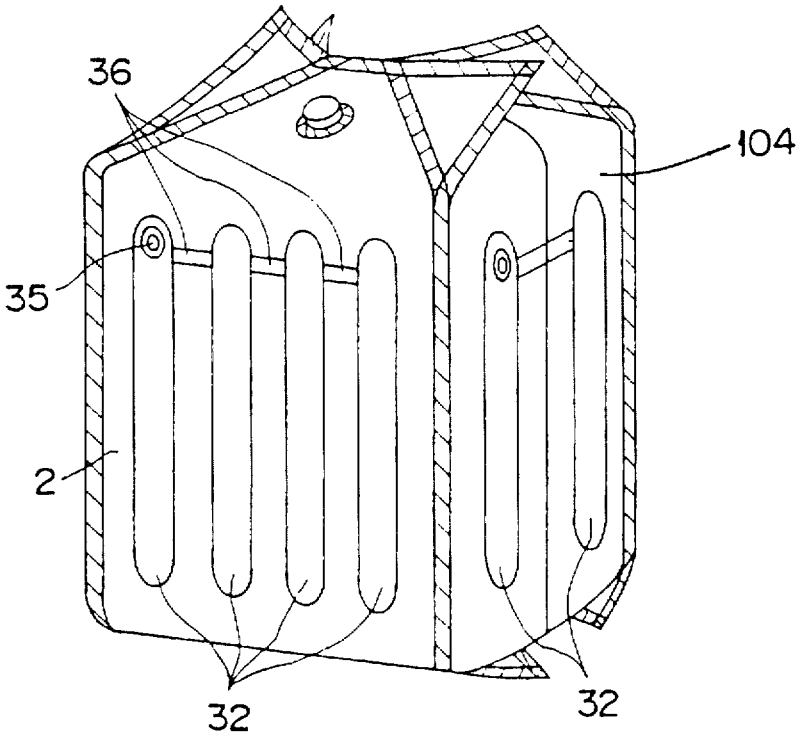
FIG. 6 is a perspective view showing a state when the content is filled into the bag according to yet another embodiment of this invention.

In the bag for the bag-in-box according to the present invention, as shown in FIGS. 5 and 6, at least one of the band-shaped film segments 31 (see FIG. 5) and the gas-filled layer 32 (see FIG. 6) extending toward the vertical direction of the bag body is attached or provided on respective flat portions 2, 3 and two side portions 5, so that it becomes possible to impart rigidity or stiffness to the shell of the gusset bag. Accordingly, the sag of the shell portion of the gusset bag can be effectively reduced and the self-supporting property of the bag can be further improved. In this regard, in a case where the band-shaped gas-filled layer 32 is provided, the heat retaining property, heat insulating property and cushioning property can also be improved.

As the band-shaped film segment 31, a synthetic resin film having a sufficient rigidity and a width of about 5 cm is commonly used, and the film segment 31 is bonded onto the shell portion of the bag body by using common bonding methods such as a heat sealing method. Specific examples of the synthetic resin film having the sufficient rigidity may include polyethylene film or polypropylene film having a thickness of 60 μm or more, preferably of 60–100 μm. Further, a paper or plastic label having a stickiness may also be attached onto the surface of the bag.

The band-shaped film segment 31 may be bonded onto the outer film 2-*a* or the inner film 2-*b* of the synthetic resin films superposed to each other. Further, a role of the film segment 31 can be allotted to one sheet of the synthetic resin films superposed to each other. For example, when the outer film 2-*a* and the inner film 2-*b* superposed to each other at the flat portions 2, 3 and the side portions 5 are partially bonded in a vertical direction of the bag body so as to form a band-shape, it becomes unnecessary to further prepare the film segment 31.

Figure 7:
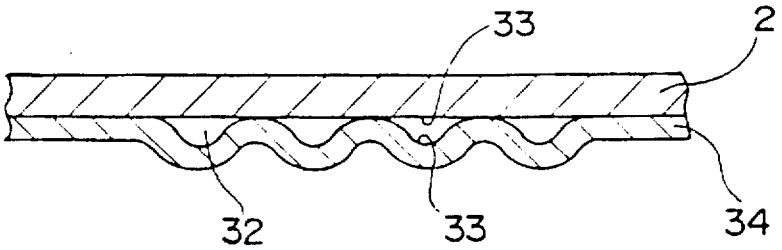
FIG. 7 is a view schematically showing a cross-sectional area of a flat portion having a gas-filled layer.

FIG. 7 is a view schematically showing a cross section of the flat portion 2 having the gas-filled layer 32 shown in FIG.

6. As shown in FIG. 7, the band-shaped gas-filled layer 32 is formed by bonding and laminating a gas-impermeable film 34 onto the outer surface of the flat portion 2 so as to retain a non-bonded portion 33 which becomes an inner surface of the gas-filled layer 32. In a case where one sheet of the synthetic resin films superposed to each other and constituting the flat portion 2 is a composite film, the composite film can also be formed so that one layer constituting the composite film shall serve as the gas-impermeable film 34. For example, the role or function of the gas-impermeable film 34 can be allotted to the outside layer 2-*a*1 of the outer film. As the bonding method for bonding the gas-impermeable film 34, methods such as heat sealing methods and the like can be used. In addition, a plurality of gas-impermeable films 34 each being individually divided so as to have one gas-filled layer can also be bonded onto the bag in a parallel form.

Explaining with reference to FIG. 6, the band-shaped gas-filled layer 32 commonly has a width of about 5 cm, and is provided with a gas inlet 35 for easily filling the gas. In place of providing the gas inlet 35 to all of the gas-filled layers 32, respectively, the gas-filled layer having the gas inlet 35 and the gas-filled layer having no gas inlet 35 may also be connected with each other by gas-supplying paths 36, thus improving a convenience of the bag.

As the gas to be filled into the gas-filled layer 32, it is preferable to use such a gas having as low a reactivity as possible. Specific examples of such a gas include air, inert gas, $N_2$ gas, $CO_2$ gas or mixture thereof. In addition, an amount of the gas to be filled into the gas-filled layer 32 is properly set at an amount imparting sufficient rigidity to the shell portion of the bag in comparison with the gusset bag having no filled gas. In order to sufficiently achieve the aforementioned object, the amount of the gas to be filled therein is set at 5 v/v % or more, preferably at 7 v/v % or more with respect to the maximum filling capacity of the gas filled layer 32.

The dimensions or sizes of the bag according to this invention are preferably determined in consideration of the International Standard of a pallet. From this point of view, in a case where the capacity of the bag is set at about 20 liters, e.g., a range of about 15 to 25 liters, the horizontal dimension of the flat portion is preferably set at 260–340 mm, the horizontal dimension of the side portion is preferably set at 180–260 mm, and the respective vertical dimensions of the flat portion and the side portion are preferably set at 490–660 mm. More preferably, the horizontal dimension of the flat portion is set at 280–320 mm, the horizontal dimension of the side portion is set at 200–240 mm, and the respective vertical dimensions of the flat portion and the side portion are set at 490–660 mm. Each of the aforementioned dimensions is expressed as a substantial dimension except the width of each seal portions.

When the bag having the aforementioned dimensions is swelled after being filled with the content, the upper and lower edges of the flat portion and the side portion enter or shift to the upper surface side and lower surface side of the bag, so that the height of the filled bag is shorter than a vertical dimension of the flat and side portions of the empty bag. The difference of the height is equivalent to the horizontal dimension of the side portion. Accordingly, when the bag having the aforementioned dimensions is filled, the bag shall take a shape of an almost a rectangular parallelepiped wherein the horizontal dimension of the flat portion is 260–340 mm, the horizontal dimension of the side portion is 180–260 mm, and the height is 230–480 mm. Therefore, when this bag is used as an inner bag, there can be provided a bag-in-box having a slightly larger dimension than that of the filled bag, and having a shape of a rectangular parallelepiped.

Figure 8:
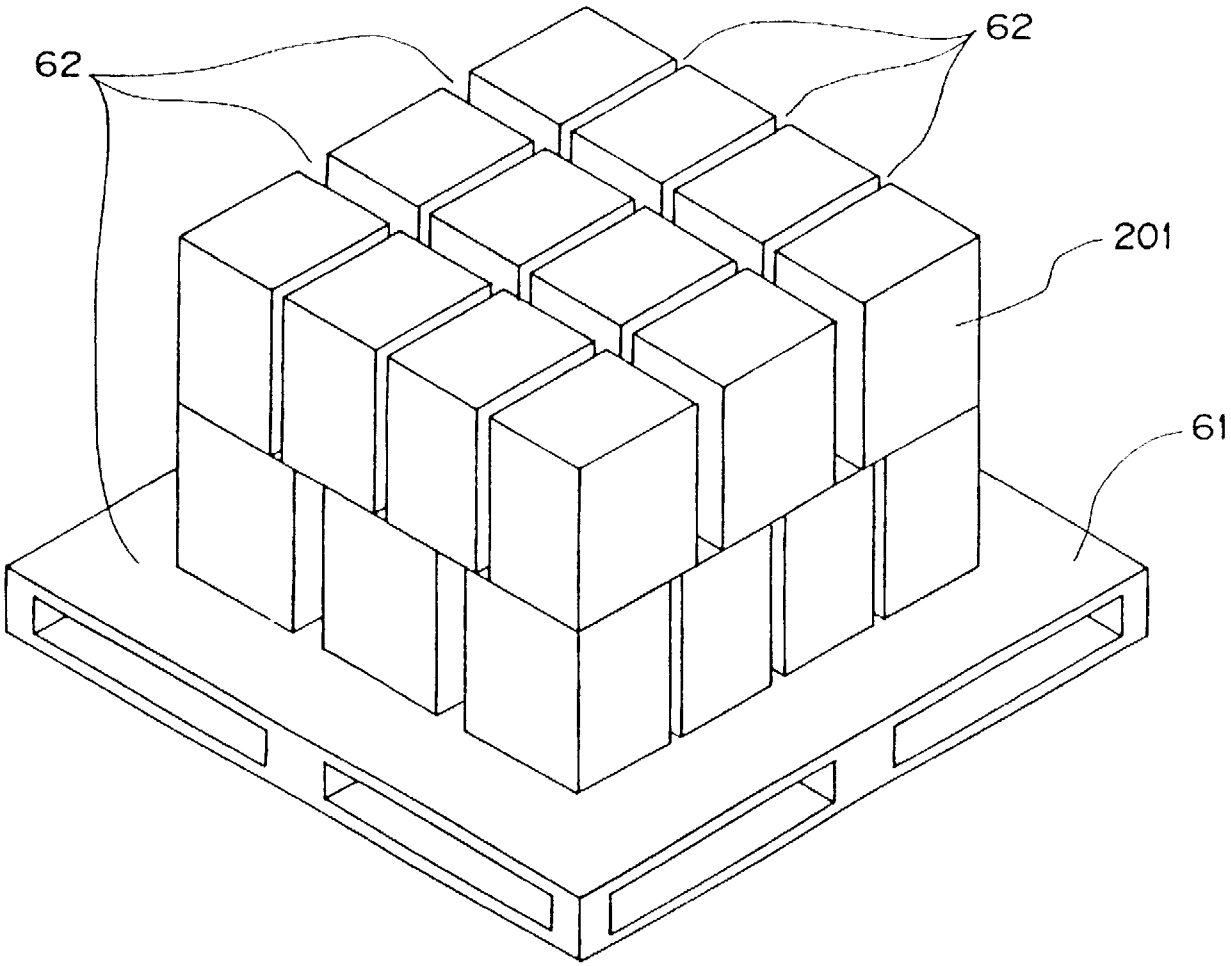
FIG. 8 is a perspective view showing a state when the bag-in-boxes each accommodating a bag for the bag-in-box of this invention are arranged on a pallet.

Thus the bag-in-box having dimensions within the specific range and having a capacity of 20 liters or so can be tightly and closely loaded onto a pallet 61 having dimensions of 1100 mm by 1100 mm in such a manner that a total of 12 bag-in-boxes are arranged in a form of 4 rows by 3 rows per every level on the pallet as shown in FIG. 8. In addition, as far as the dimensions of the bag-in-box are set within the above described ranges, the shape of the respective bag-in-boxes will not become too thin or too slender but becomes compact, so that it is easy for a user to grasp or handle the bag-in-box. Each bag-in-box has a sufficient stability and high strength. In addition, the bag-in-box with the aforementioned dimensions has a shape of a rectangular parallelepiped. Therefore, as shown in FIG. 8, the bag-in-box can be stacked on the pallet 61 in a well-crib form by changing the arranging direction at every level, so that an entire stack can also have a sufficient stability and high strength.

In a case where the capacity of the bag is required to be controlled within the range of the respective dimensions, the capacity can be easily controlled by changing only vertical dimensions of the flat portion and the side portion.

For example, when the horizontal dimension of the flat portion is set at 300 mm which is expressed as a substantial dimension except the width of the seal portions, the horizontal dimension of the side portion is set at 220 mm, and each of the vertical dimension of the flat portion and the side portion is set at 575 mm, there can be provided a bag having a capacity of 20 liters, such that the horizontal dimension of the flat portion is 300 mm, the horizontal dimension of the side portion is 220 mm, and height is 334 mm at the time of the bag being filled. Then, this bag is accommodated within an outer box having outer dimensions of 320 mm×240 mm×390 mm, thereby forming a bag-in-box.

In contrast to this, among the dimensions described above, when only the vertical dimensions of the flat portion and the side portion are changed to 491 mm while the other dimensions are kept unchanged, there can be provided a bag having a capacity of 15 liters, such that the horizontal dimension of the flat portion is 300 mm, the horizontal dimension of the side portion is 220 mm, and height is 250 mm at the time of the bag being filled. Then, this bag is accommodated within an outer box having outer dimensions of 320 mm×240 mm×300 mm, thereby forming another bag-in-box.

In addition, among the dimensions described above, when only the vertical dimensions of the flat portion and the side portion are changed to 658 mm while the other dimensions are kept unchanged, there can be provided a bag having a capacity of 25 liters, such that the horizontal dimension of the flat portion is 300 mm, the horizontal dimension of the side portion is 220 mm, and the 1316 height is 417 mm at the time of the bag being filled. Then, this bag is accommodated within an outer box having outer dimensions of 320 mm×240 mm×470 mm, thereby forming still another bag-in-box.

Also in a case where the capacity of the bag according to this invention is set at about 10 liters, e.g., a range of about 5 to 15 liters, the dimensions of the bag are preferably determined in consideration of the International Standard of a pallet. From this point of view, in a case where the capacity of the bag is set at about 10 liters, the horizontal dimension of the flat portion is preferably set at 190–270 mm, the horizontal dimension of the side portion is preferably set at 140–220 mm, and the respective vertical dimensions of the flat portion and the side portion are preferably set at 330–600 mm. More preferably, the horizontal dimension of the flat portion is set at 210–250 mm, the horizontal dimension of the side portion is set at 160–200 mm, and the respective vertical dimensions of the flat portion and the side portion are set at 330–600 mm. Each of the aforementioned dimensions is expressed as a substantial dimension except for the width of each seal portions.

When the bag having the aforementioned dimensions is filled with content, the bag shall take a shape of an almost a rectangular parallelepiped wherein the horizontal dimension of the flat portion is 190–270 mm, the horizontal dimension of the side portion is 140–220 mm, and the height is 110–460 mm. Therefore, when this bag is used as an inner bag, there can be provided a bag-in-box having slightly larger dimensions than that of the bag after being filled, and having a shape of a rectangular parallelepiped.

Thus, the bag-in-box having dimensions falling within the specific range and having a capacity of 10 liters or so can be tightly and closely loaded on the internationally standardized pallet in such a manner that 20 bag-in-boxes in total are arranged in a form of 5 rows by 4 rows for every level on the pallet. In addition, the bag-in-box is formed to be compact, so that it is easy for a user to grasp or handle the bag-in-box.

In addition, the bag-in-box has a sufficient stability and high strength. Further, the bag-in-box can be stacked on the pallet in a well-crib form by changing the arranging direction at every level, so that an entire stack can also have a sufficient stability and high strength.

Also in a case where the capacity of the bag having a capacity of 10 liters or so is required to be controlled, the capacity can be easily controlled by changing only vertical dimensions of the flat portion and the side portion. For example, when the horizontal dimension of the flat portion is set at 230 mm which is expressed as a substantial dimension for except the width of the seal portions, the horizontal dimension of the side portion is set at 180 mm, and each of the vertical dimensions of the flat portion and the side portion is set at 464 mm, there can be provided a bag having a capacity of 10 liters, such that the horizontal dimension of the flat portion is 230 mm, the horizontal dimension of the side portion is 180 mm, and height is 266 mm at the time of the bag being filled. Then, this bag is accommodated within an outer box having outer dimensions of 250 mm×200 mm×320 mm, thereby forming a bag-in-box.

In contrast to this, among the dimensions described above, when only the vertical dimensions of the flat portion and the side portion are changed to 331 mm while the other dimensions are kept unchanged, there can be provided a bag having a capacity of 5 liters, such that the horizontal dimension of the flat portion is 230 mm, the horizontal dimension of the side portion is 180 mm, and the height is 133 mm after the bag being level. Then, this bag is accommodated within an outer box having outer dimensions of 250 mm×200 mm×190 mm, thereby forming another bag-in-box. another.

In addition, among the dimensions described above, when only the vertical dimensions of the flat portion and the side portion are changed to 597 mm while the other dimensions are kept unchanged, there can be provided a bag having a capacity of 15 liters, such that the horizontal dimension of the flat portion is 230 mm, the horizontal dimension of the side portion is 180 mm, and the height is 399 mm after the bag being filled. Then, this bag is accommodated within an outer box having outer dimensions of 250 mm×200 mm×450 mm, thereby forming still another bag-in-box.

As the outer box for accommodating the aforementioned bag for the bag-in-box, a conventionally available outer box for the bag-in-box can be used. A typical example of the outer box for the bag-in-box is a corrugated fiberboard box. However, when the corrugated fiberboard box is used, there may be a case where powdery papers are unavoidably generated and are liable to adhere to an outer surface of the inner bag, or drift into the surroundings of the bag-in-box. In this case, it is preferable to use a container composed of a material such as plastic which is free from generating the powdery paper.

In a case where the plastic container having an excellent durability is used as the outer box, the outer box shall not be discarded but shall be recovered, thus making it possible to re-use the outer box repeatedly. The re-used type outer box may preferably be formed into a foldable type. The foldable type outer box is suitable for accommodating an inner bag having a relatively small capacity of 10 liters or less. Such an inner bag is commonly used where the bag being taken out from the outer box. In addition, there may be a case where the foldable type container has an insufficient light shielding property. In such a case, it is preferable to use an inner bag composed of a synthetic resin film having at least one layer formed of metal foil such as aluminum foil.

A wall surface of the outer box is required to be provided with an opening portion for protruding the spout of the inner bag through the opening portion. In view of this, the wall surface of the outer box is commonly provided with an unsealing assisting member such as perforation. The opening portion is formed by using the unsealing assisting member at the time when the bag-in-box is starting to be used.

This opening portion to be formed by using the unsealing assisting member may preferably have a sufficient size sufficient to draw out bag body portion around the spout in a sufficient length when the spout is protruded from the outer box through the opening portion.

Figure 9A:
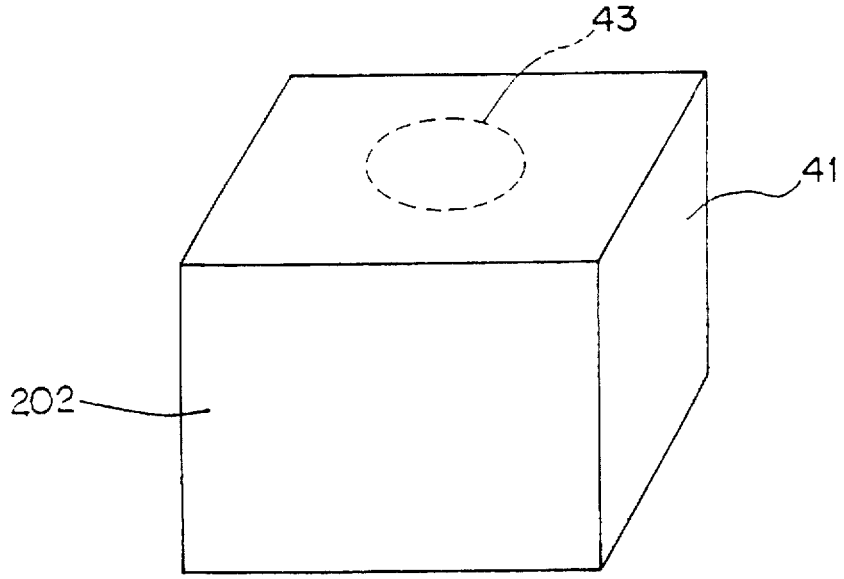
FIG. 9(A) shows a state before unsealing of the box.

FIG. 9 shows a perspective view of the bag-in-box 202 formed by combining the outer box having such an unsealing assisting member and the bag for the bag-in-box of this invention. As shown in FIG. 9(A), the outer box 41 for the bag-in-box is provided with an unsealing assisting member 43. The unsealing assisting member, for example, a tear tape, can also be utilized in addition to the perforation as shown in FIG. 9(A).

Though it is not shown, a bag for a bag-in-box of this invention is accommodated within the outer box 41, and the spout of the bag is located just below the unsealing assisting member 43 which is to be an opening portion. The spout is required to be drawn out from the opening portion after the unsealing, so that the spout is not fixed to the outer box. A material for constituting the outer box is not particularly restricted, for example, corrugated fiberboard or the like can be used as the material.

Figure 9B:
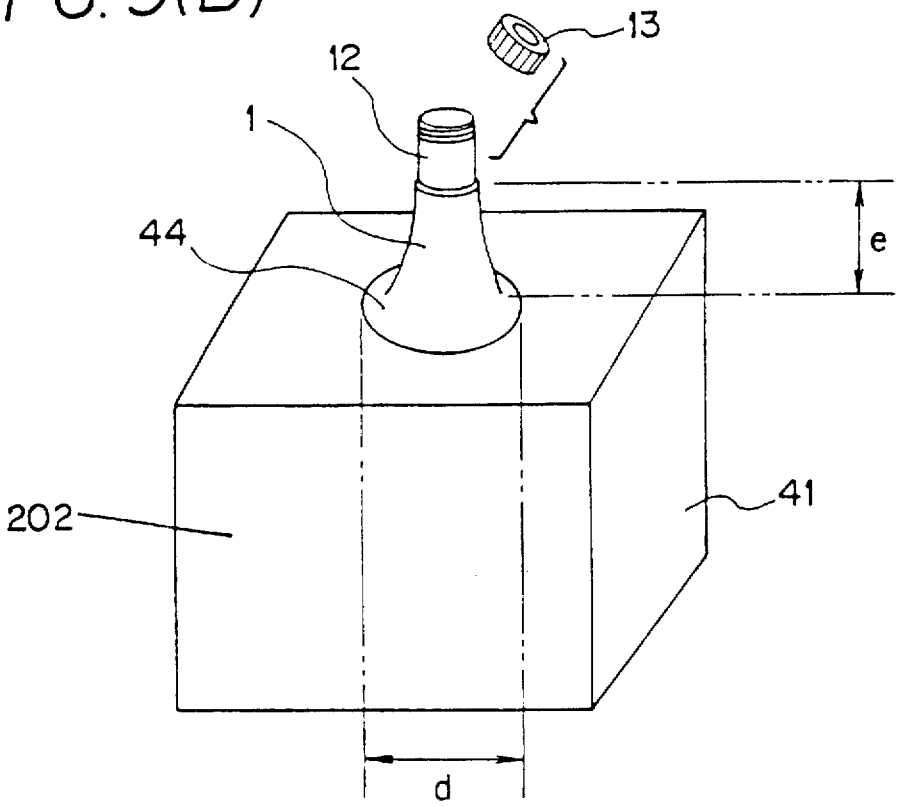
FIG. 9(B) shows a state when a spout is drawn out after unsealing of the box.

As shown in FIG. 9(B), when the aforementioned bag-in-box 202 is unsealed, the opening portion 44 is formed. In this regard, the shape of the opening portion is not particularly restricted, and specific examples of such shape include spherical, ellipsoid, quadrangle, hexagon and octagon. A diameter of the opening portion 44 shall have a size sufficient to draw out the spout 12 with a cap 13 thereon and the bag body 1 around the spout 12.

When the spout and the bag body are drawn out from the opening portion, the bag body 1 around the spout can be formed in a funnel shape, thereby reducing the folds and crumples formed on the bag body. As a result, the residual content is easily collected into the spout, and is smoothly discharged. Therefore, the residual content hardly remains and pulsation of the content scarcely occurs. In addition, the spout can be easily handled as if it were a hose end, so that the user can easily grasp the spout, and easily control the pouring direction of the content. Furthermore, the user can easily and visually confirm the amount of the residual content remaining in the vicinity of the spout.

A length e of the bag body around the spout to be drawn out from the opening portion may preferably be set at 50 mm or more, more preferably at 60 mm or more. Even though the length e is set longer than a certain length, a better convenience of the bag can not always be obtained in proportion to the longer length. The spout rather obstructs the box in handling or operation, and it becomes necessary to greatly increase the size or diameter d of the opening portion. From this point of view, the length e of the bag body to be drawn out from the opening portion may preferably be set at 150 mm or less, more preferably at 100 mm or less.

A particular size of the diameter d sufficient to draw out the bag body 1 around the spout in a length of 50 mm or more, more preferably 50–150 mm, shall be optionally determined. However, when the diameter d is commonly set at within a range of 50–150 mm, a proper length of the bag body can be drawn out. In this regard, it should be noted that the term "diameter" in this specification means "an ordinary diameter" in case of the shape of the opening portion being a circle, or means "a minor diameter" in case of the shape other than a circle.

Figure 10A:
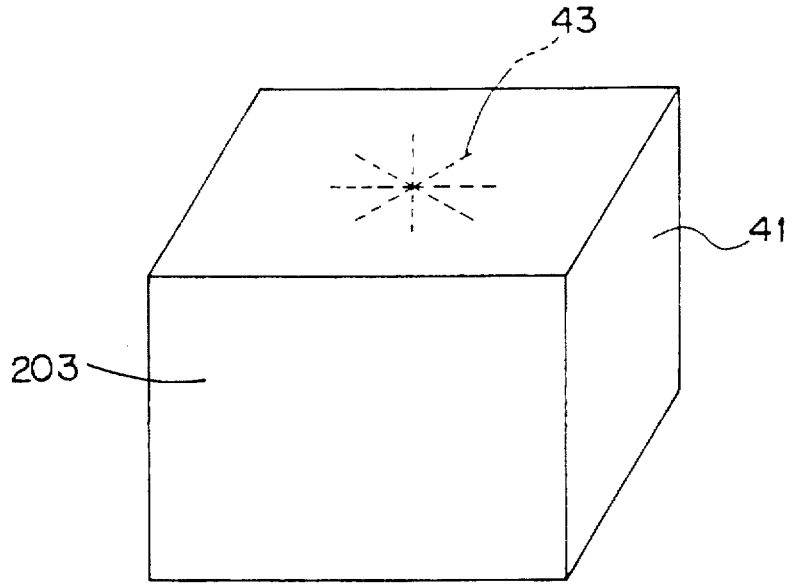
FIG. 10(A) shows a state before unsealing of the box.
Figure 10B:
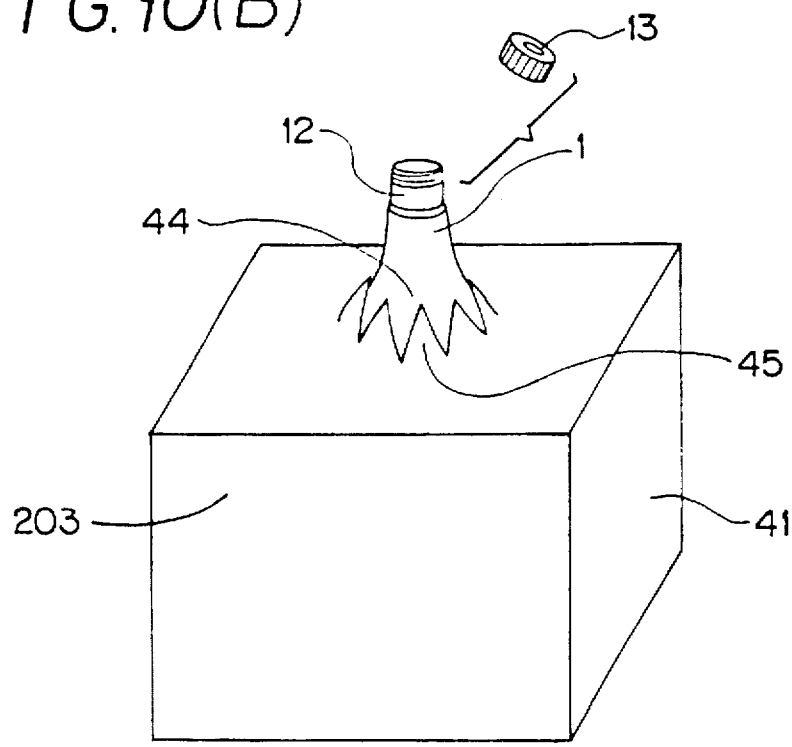
FIG. 10(B) shows a state when a spout is drawn out after unsealing of the box.

According to the unsealing assisting member 43 shown in FIGS. 10 (A) and (B), a wall surface of the outer box 41 can be radially torn from a center point of the opening portion, and after the unsealing, fan-shaped torn pieces 45 remain at surrounding of the opening portion 44.

In this case, the bag body 1 around the spout drawn out from the opening portion is suppressed or supported by the fan-shaped torn pieces 45 remaining at the surrounding of the opening portion, so that a position of the spout 12 can be advantageously stabilized.

Figure 11A:
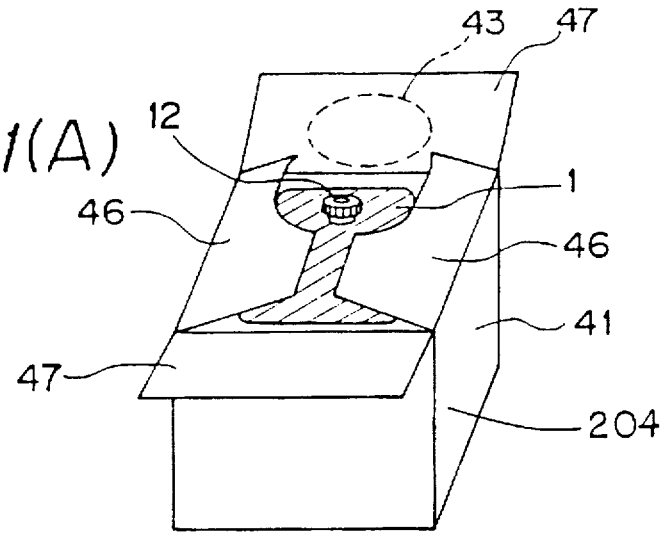
FIG. 11(A) shows a stage of assembling of the bag-in-box.
Figure 11B:
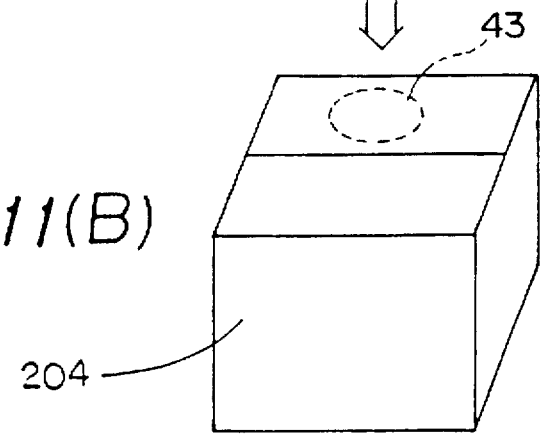
FIG. 11(B) shows a state after completion of the bag-in-box.
Figure 11C:
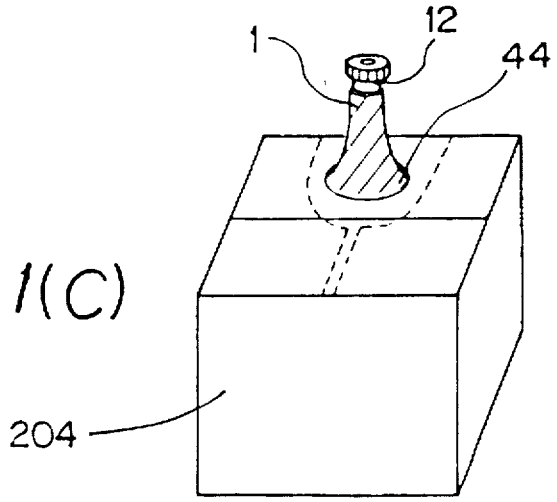
FIG. 11(C) shows a state when a spout is drawn out after unsealing of the box.
Figure 12:
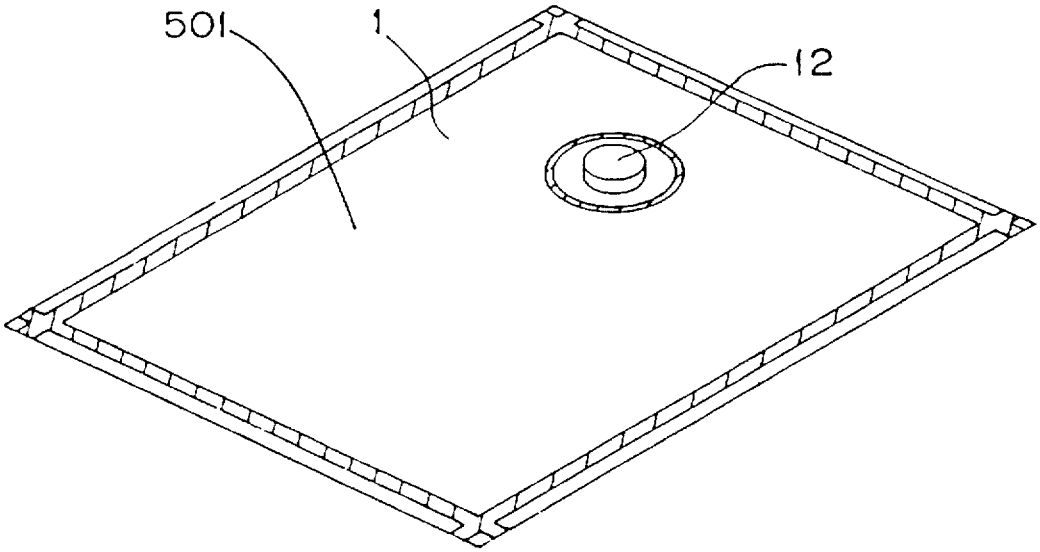
FIG.12 PRIOR ART
FIG. 12 is a perspective view showing an example of a conventional inner bag for a bag-in-box.
Figure 13:
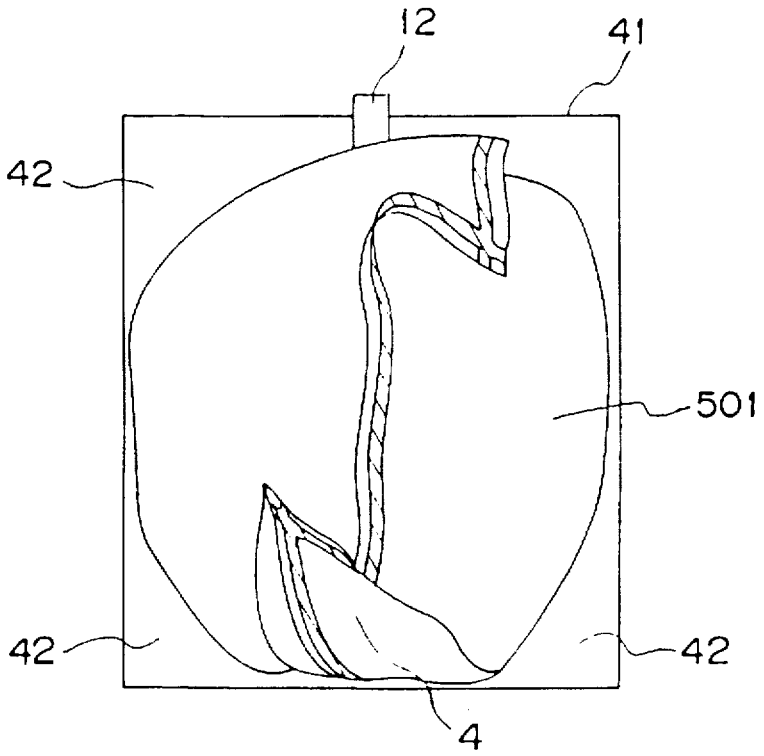
FIG. 13 PRIOR ART
FIG. 13 is a view showing a state when the inner bag shown in FIG. 12 is accommodated within the outer box.

FIGS. 11(A)–(C) respectively show perspective views of the bag-in-box 204 formed by combining the outer box 41 having such unsealing assisting member 43 and the bag for the bag-in-box of this invention. As shown in FIG. 11(A), at the top portion of the outer box 41, there is provided a bilateral pair of inner flaps 46, 46 and another bilateral pair of outer flaps 47, 47, respectively. Each of the inner flaps 46, 46 is cut out in an almost circular arc form so as not to obstruct the spout 12 and bag body 1 at the time when the spout 12 of the inner bag accommodated in the outer box 41 and the bag body 1 around the spout 12 are drawn from the opening portion. When the inner flaps 46, 46 are closed, there is formed a cut-out portion having a shape of almost semi-circular.

In addition, one of the outer flaps 47 is provided with the unsealing assisting member 43 at a portion against which the spout abuts. When the inner flaps 46, 46 and the outer flaps 47, 47 are closed in this order, and subsequently the outer box is sealed without fixing the spout to the outer box, whereby a bag-in-box 204 as shown in FIG. 11(B) can be accomplished. Then, the opening portion 44 having a predetermined size can be formed by using this unsealing assisting member 43 of the bag-in-box 204, whereby the spout 12 and the bag body 1 around the spout 12 can easily be drawn out through the opening portion 44 as shown in FIG. 11(C).

It is also possible to combine the aforementioned outer box and a four-side seal type bag such as a flat bag to be used as an inner bag which can be manufactured by seal working of the synthetic resin films. Also in case of the bag-in-box composed of such combination, the spout and the bag body around the spout can easily be drawn out through the opening portion, whereby various effects can be obtained such that the amount of the residual content can be decreased, the pulsation of the effluent can be prevented. Also, it becomes easy to control the discharging direction of the content and to visually confirm the amount of the residual content. Further, a part of the seal portions to be formed at the circumference of the four-side seal type bag can be omitted by performing a folding of the synthetic resin film.

Hereinbelow, the present invention will be described in more detail with reference to following Experimental

EXAMPLES AND COMPARATIVE EXAMPLE.

Experimental Example 1

A four-side seal type bag having a shape shown in FIG. 1 was prepared. The bag has a capacity of 20 liters, and has flat portions and side portions each composed of a composite film having a laminar construction of {15 μm- thick oriented nylon (ON)/20 μm-thick polyethylene(PE)/60 μm-thick linear low density polyethylene (LLDPE)} and a a single layer film composed of 60 μm-thick LLDPE.

The bag has the following dimensions in terms of a substantial dimension for except the width of the seal portions. Namely, the horizontal dimension of the flat portion is 300 mm, the horizontal dimension of the side portion is 220 mm, each of vertical dimensions of the flat portion and the side portion is 575 mm and the width of the folded gusset is 110 mm.

In the triangular portion of top side, the length of the side along the top portion is 110 mm, the length of the side along the side portion is 131 mm, and the angle lying between the top seal portion and the oblique seal portion is 50 degrees. On the other hand, in the fin portion of the bottom side, each of the lengths of the side along the bottom portion and the length of the side along the side portion is 110 mm, and the angle lying between the bottom seal portion and the oblique seal portion is 45 degrees.

This bag was then accommodated within an outer box of private use for BIB (bag-in-box) thereby forming a BIB of Experimental Example 1. Next, the BIB was filled up with water as content, and then the content was discharged from the spout portion. In the beginning of the discharging operation, the operation was performed in such a manner that the user held both ends of the box with his hands while the bottom edge of the box was supported by being abutted onto an edge of a vessel for receiving the discharged water. Subsequently, in accordance with the decreasing of the residual content, the user moderately inclined or tilted the box thereby discharging the content. In the final stage, the user held the box with his hands so as to keep the box in a horizontal state while the spout portion was kept so as to point just downward until the effluent of water was completely broken or interrupted. At a time just before the content of water was running short or used up, the user slightly swung the box from back to forth and to both sides, thus enabling to easily discharge the water. After the completion of the discharging of the water, the flap potions were opened and the condition of the bag was carefully observed.

As the result, judging from the box by appearance thereof, the folded portion of the bag into which the residual content remaining was not observed at all. Further, the empty bag was taken out from the outer box, and reversed upside down. In this state, the residual water remaining in the bag was discharged and received into a beaker. Then an amount of the residual water was measured by means of a measuring cylinder.

The aforementioned measuring operation was repeated five times. As the result, the amount of the residual water ranged from substantially zero to 10 ml at most, thus obtaining an excellent result. From this result, the bag of this Example was confirmed to have an excellent construction into which the residual content would not remain.

In this regard, the measured residual content is assumed to be formed by collecting the water adhered to the inner surface of the bag.

Experimental Example 2

With respect to two kinds of the bags each having a shape shown in FIG. 1 and respectively having a capacity of 10 liters or 5 liters, the same experiments as in Experimental Example 1 were conducted. Substantially the same results were obtained.

The bag having a capacity of 10 liters used in the experimental procedures comprised the flat portions and the side portions each composed of two sheets of films as used in Experimental Example 1.

The bag had the following dimensions in terms of a substantial dimension except for the width of the seal portions. Namely, the horizontal dimension of the flat portion was 230 mm, the horizontal dimension of the side portion was 180 mm, each of vertical dimensions of the flat portion and the side portion was 464 mm and the width of the folded gusset was 90 mm.

In the fin portion of top side of the bag, the length of the side along the top portion was 90 mm, the length of the side along the side portion was 108 mm, and the angle lying between the top seal portion and the oblique seal portion was 50 degrees. On the other hand, in the fin portion of bottom side of the bag, each of the lengths of the side along the bottom portion and the length of the side along the side portion was 90 mm, and the angle lying between the bottom seal portion and the oblique seal portion was 45 degrees.

On the other hand, the bag having a capacity of 5 liters used in the experimental procedures also comprised the flat portions and the side portions each composed of two sheets of films as used in Experimental Example 1.

The bag had the following dimensions in terms of a substantial dimension except for the width of the seal portions. Namely, the horizontal dimension of the flat portion was 230 mm, the horizontal dimension of the side portion was 180 mm, each of vertical dimensions of the flat portion and the side portion was 331 mm and the width of the folded gusset was 90 mm.

In the fin portion of top side, the length of the side along the top portion was 90 mm, the length of the side along the side portion was 108 mm, and the angle lying between the top seal portion and the oblique seal portion was 50 degrees. On the other hand, in the fin portion of bottom side, each of the lengths of the side along the bottom portion and the length of the side along the side portion was 90 mm, and the angle lying between the bottom seal portion and the oblique seal portion was 45 degrees.

Comparative Example 1

A flat pouch bag, which was available in a market and had a capacity of 20 liters, was prepared. This bag was then accommodated within an outer box of exclusive use for BIB (bag-in-box) forming a BIB of Comparative Example 1. Next, the BIB was filled up with water. With respect to the thus formed BIB, the same experiments as in Experimental Example 1 were conducted. Namely, the content of water filled up in the bag-in-box was discharged from the flat pouch bag as an inner bag.

As a result, however, the effluent of water was not completely interrupted or broken even in a final stage of discharging the water from the bag-in-box, and the effluent of water continued endlessly. After the effluent of water was completely interrupted, the cover of the box was opened and the condition of the bag was carefully observed.

As a result, if could be observed that both of the corner portions of the top surface side of the bag and both of the corner portions of the bottom surface side of the bag were folded uniformly in a triangular shape into which no little amount of the residual content remained.

As is the same manner in Experimental Example 1, the residual water remaining in the bag was discharged and received into a beaker. Then, an amount of the residual water was measured by means of a measuring cylinder. The aforementioned measuring operation was repeated five times. As a result, the amount of the residual water was so large as to range from 100 to 200 ml. In this regard, the reason why the wide variation of the amounts of the residual was large is assumed that the shapes of the triangular folded portions formed at both corner portions of upper and bottom surface sides are not uniform, so that the amounts of water remaining in the respective folded portions are also widely varying.

As described above, according to the bag for bag-in-box of the present invention, each of the corner portions of the bag having a columnar structure is provided with an oblique seal portion formed just like obliquely cutting-off the respective corner portions, so that the bag shall take a shape close to a cube or a rectangular parallelepiped. In addition, the inner bag is formed of several sheets of synthetic resin films superposed to each other so as forming a multiplex structure. Therefore, when the bag is accommodated within an outer box, a dead space is hardly formed between the outer box and the bag. The bag also hardly moves within the box, so that the bag is hard to burst due to the impact or vibration, and is also hard to break due to the rubbing of the inner bag. Further, the oblique seal portion has a stress-dispersing effect with respect to an impact applied to the bag, so that the impact resistance of the bag body can also be improved.

Further, the bag for bag-in-box according to the present invention has a construction so that the liquid content filled in the bag cannot enter the respective corner portion. Therefore, even if the respective corner portion is crumpled or bent at the time of accommodating the bag in the outer box, there is no case of the residual content remaining in the corner portion, so that the residual discharging property of the bag-in-box can be improved.

In particular, when an angle lying between the top seal portion and the oblique seal portion is set at 45–55 degrees, and an angle lying between the bottom seal portion and the oblique seal portion is set at 40–50 degrees, the oblique seal portion can be provided along the exact portion at which each of the corner portions of both top and bottom sides is crumpled or bent. Thus, the residual content can be effectively prevented from remaining in the corner portion while ensuing a maximum capacity of the bag.

Though the triangular fin portion formed by intercepting or isolating the respective corner portion from the inner space of the bag is inherently an unnecessary portion for the bag, the triangular fin portion can be used for improving the property of the bag. Namely, when the opposing top points of the corner portions formed at front and back sides of the bag body are bonded to each other, the triangular fin portion would not obstruct the operation of the bag, and it becomes possible to prevent rubbing, tearing, or pin-holing caused on a bag wall.

In addition, when the opposing triangular fin portions of both front and back sides are partially bonded to each other, or when a punched hole for engaging a hook thereto is formed on the triangular fin portion, the linking fin portions or the punched hole can be used as a hanger portion for hanging or suspending the inner bag.

Furthermore, the bag for the bag-in-box of this invention shall take a shape close to a cube or a rectangular parallelepiped when the bag is filled with liquid content, so that the bag is excellent in self-supporting and handling. In addition, when a band-shaped film segment or a gas-filled layer extending toward the vertical direction of the bag body is attached or provided on a shell portion of the bag body, it becomes possible to impart rigidity or stiffness to the shell portion of the bag, so that the self-supporting property of the bag can be further improved, and it becomes possible to handle the bag more easily.

In the present invention, when the bag is formed so as to have a shape of a rectangular parallelepiped at the time of the bag being filled with liquid content, and the horizontal dimension of the flat portion is set at 260–340 mm, the horizontal dimension of the side portion is set at 180–260 mm, the vertical dimension of each of the flat and side portions is set at 490–660 mm, each of the dimensions being expressed as a substantial dimension which is defined by subtracting a width of the seal portion from an actual dimension of each portion, or when the horizontal dimension of the flat portion is set at 190–270 mm, the horizontal dimension of the side portion is set at 140–220 mm, the vertical dimension of each of the flat and side portions is set at 330–600 mm, each of the dimensions being expressed as a substantial dimension which is defined by subtracting a width of the seal portion from an actual dimension of each portion, there can be provided a bag-in-box which can be tightly and closely loaded or piled on the internationally standardized pallet, and has a compact shape, high strength and an excellent stability. In addition, even in a case where a lot of the bag-in-boxes are stacked on the pallet in a heap form, the entire stack can also have a sufficient stability and high strength.

On the other hand, the bag-in-box of this invention is constructed by comprising an inner bag composed of the bag for the bag-in-box of this invention or a four-side seal type bag formed of synthetic resin film, an outer box for accommodating the inner bag therein, and a means provided on the outer box for forming an opening portion sufficient to draw out the bag body around the spout in a length of 50 mm or more, so that the following various effects can be obtained the amount of the residual content can be decreased, the pulsation of the effluent can be prevented. Also, it becomes easy to control the discharging direction of the content and to visually confirm the amount of the residual content. In particular, when the fan-shaped torn pieces remain at the surroundings of the opening portion, a position of the spout can be effectively stabilized.

What is claimed is:

1. A bag used as an inner bag for a bag-in-box having an outer box and the inner bag accommodated within the outer box, said bag comprising:

a four-side-seal type bag body composed of a pair of opposing flat portions constituting front and back side portions and two side portions connecting front and back side portions at both side ends thereof and respectively having folding lines along which the side portions are folded inward;

oblique seal portions provided at respective corner portions of the bag body; and triangular fin portions formed at respective corner portions of the bag body;

wherein said flat portions and said side portions are composed of at least two sheets of synthetic resin films that are superposed to each other in a non-bonded state;

wherein said oblique seal portion is formed such that the two side portions are folded along the folding line, opposing inner surfaces of the bag body are bonded to each other between a first arbitrary point on top seal portion or bottom seal portion to a second arbitrary point on a side seal portion so as to obliquely connect said top seal portion or bottom seal portion and the side seal portion, the oblique seal portion being linear;

wherein said triangular fin portion being defined by the side seal portion, the oblique seal portion and one of the top seal portion and the bottom seal portion;

and wherein each of said flat portions and said side portions has a shape of a square or a rectangle, and the bag being a cube or a rectangular parallelepiped when filled.

2. A bag for the bag-in-box according to claim 1, wherein the first arbitrary point is located within 1 cm of the folding line when said bag is folded.

3. A bag for the bag-in-box according to claim 1, wherein opposing top portions of the corner portions formed at front and back sides of the bag body are bonded to each other.

4. A bag for the bag-in-box according to claim 1, wherein at least one band-shaped gas-filled layer extending toward vertical direction of the bag body is provided on each of a pair of flat portions and two side portions, respectively.

5. A bag for the bag-in-box according to claim 1, wherein a bilaterally pair of hanger portions are formed on at least one of said top and bottom sides of the bag body, said hanger portions being formed by bonding said opposing triangular fin portions of both front and back sides to each other at the top portions of the corner portions, and by further bonding said opposing triangular fin portions at another portion consisting of at least one portion on said top seal portion or said bottom seal portion.

6. A bag for the bag-in-box according to claim 1, wherein a punched hole is formed on at least one of the triangular fin portions.

7. A bag for the bag-in-box according to claim 1, wherein said synthetic resin film contains at least one metal foil layer.

8. A bag for the bag-in-box according to claim 1, wherein an angle lying between the top seal portion and the oblique seal portion is 45–55 degrees, and an angle lying between the bottom seal portion and the oblique seal portion is 40–50 degrees.

9. A bag for the bag-in-box according to claim 1, wherein horizontal dimension of the flat portion is 260–340 mm, horizontal dimension of the side portion is 180–260 mm, vertical dimension of each of the flat and side portions is 490–660 mm, each of said dimensions being expressed as a substantial dimension which is defined by subtracting width of the seal portion from actual dimension of each portion, and a shape of the bag after filling up content therein is a rectangular parallelepiped.

10. A bag for bag-in-box according to claim 1, wherein horizontal dimension of the flat portion is 190–270 mm, horizontal dimension of the side portion is 140–220 mm, vertical dimension of each of the flat and side portions is 330–600 mm, each of said dimensions being expressed as a substantial dimension which is defined by subtracting width of the seal portion from actual dimension of each portion, and a shape of the bag after filling up content therein is a rectangular parallelepiped.

* * * * *